US009121118B2

(12) United States Patent
Gupta et al.

(10) Patent No.: US 9,121,118 B2
(45) Date of Patent: Sep. 1, 2015

(54) METHOD AND APPARATUS FOR FORMING A FIBROUS MEDIA

(75) Inventors: Hemant Gupta, Apple Valley, MN (US); Ajay Singh, Apple Valley, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 458 days.

(21) Appl. No.: 13/358,623

(22) Filed: Jan. 26, 2012

(65) Prior Publication Data

US 2012/0193056 A1 Aug. 2, 2012

Related U.S. Application Data

(60) Provisional application No. 61/437,218, filed on Jan. 28, 2011.

(51) Int. Cl.
*D21F 11/06* (2006.01)
*D04H 1/70* (2012.01)
(Continued)

(52) U.S. Cl.
CPC ..... *D04H 1/70* (2013.01); *D04H 1/736* (2013.01); *D04H 18/04* (2013.01); *D21F 11/06* (2013.01)

(58) Field of Classification Search
CPC ..... D21F 11/06; D21F 11/08; D04H 1/70; D04H 1/72; D04H 1/732; D04H 1/736
USPC ..... 162/281, 282, 302, 318, 321, 327, 328, 162/329, 357, 368, 112, 212
See application file for complete search history.

(56) References Cited

U.S. PATENT DOCUMENTS 2,036,168 A * 3/1936 Engert et al. ..... 162/318
3,073,735 A 1/1963 Till et al.
3,119,733 A 1/1964 Wilson et al.
(Continued)

FOREIGN PATENT DOCUMENTS

CN 1279241 10/2006
DE 2004046669 3/2006
(Continued)

OTHER PUBLICATIONS

"Communication Pursuant to Rules 161(1) and 162 EPC", from EP Application No. 12702726.6, mailed Sep. 4, 2013, 2 pages.
(Continued)

*Primary Examiner* — Timothy Kennedy
(74) *Attorney, Agent, or Firm* — Pauly, DeVries Smith & Deffner LLC

(57) ABSTRACT

Disclosed herein are cylinder forming apparatuses for making nonwoven webs. In one embodiment, a cylinder forming apparatus has a first source configured to dispense a first fluid flow stream, and a second source configured to dispense a second fluid flow stream, wherein at least the first fluid flow stream comprises a fiber; an arcuate mixing partition downstream from the one or more sources, the arcuate mixing partition positioned between the first and second flow streams, the apparatus defining one or more openings that permit fluid communication between the two flow streams; and a cylindrical receiving region situated downstream from the sources and proximal to the first flow stream and designed to receive at least a combined flow stream and form a nonwoven web by collecting fiber from the combined flow stream. Methods of using the apparatuses are also disclosed.

15 Claims, 12 Drawing Sheets

(51) Int. Cl.
*D04H 1/736* (2012.01)
*D04H 18/04* (2012.01)

(56) References Cited

U.S. PATENT DOCUMENTS

| | | | | |
|---|---|---|---|---|
| 3,252,854 | A * | 5/1966 | Bowen | 162/321 |
| 3,352,748 | A * | 11/1967 | Krofta | 162/357 |
| 3,514,372 | A | 5/1970 | Boyce | |
| 3,515,635 | A | 6/1970 | Curtis | |
| 3,699,627 | A | 10/1972 | Jouin | |
| 3,720,578 | A | 3/1973 | Heling | |
| RE28,269 | E | 12/1974 | Hill et al. | |
| 4,018,646 | A | 4/1977 | Ruffo et al. | |
| 4,082,476 | A | 4/1978 | Kopelev | |
| 4,321,108 | A | 3/1982 | Goddard et al. | |
| 4,731,135 | A | 3/1988 | Tani et al. | |
| 4,765,915 | A | 8/1988 | Diehl | |
| 4,902,418 | A | 2/1990 | Ziegler | |
| 4,904,385 | A | 2/1990 | Wessling et al. | |
| 5,011,575 | A | 4/1991 | Keller | |
| 5,147,553 | A | 9/1992 | Waite | |
| 5,173,154 | A | 12/1992 | Heinrich | |
| 5,238,474 | A | 8/1993 | Kahlbaugh et al. | |
| 5,336,556 | A | 8/1994 | Yoshida et al. | |
| 5,350,624 | A | 9/1994 | Georger et al. | |
| 5,423,892 | A | 6/1995 | Kahlbaugh et al. | |
| 5,545,475 | A | 8/1996 | Korleski | |
| 5,571,604 | A | 11/1996 | Sprang et al. | |
| 5,622,537 | A | 4/1997 | Kahlbaugh et al. | |
| 5,639,352 | A | 6/1997 | Ruf et al. | |
| 5,645,689 | A | 7/1997 | Ruf et al. | |
| 5,645,690 | A | 7/1997 | Cox, Jr. | |
| 5,669,949 | A | 9/1997 | Dudrey et al. | |
| 5,762,669 | A | 6/1998 | Kahlbaugh et al. | |
| 5,762,670 | A | 6/1998 | Kahlbaugh et al. | |
| 5,792,227 | A | 8/1998 | Kahlbaugh et al. | |
| 5,797,973 | A | 8/1998 | Dudrey et al. | |
| 5,800,587 | A | 9/1998 | Kahlbaugh et al. | |
| 5,972,063 | A | 10/1999 | Dudrey et al. | |
| 5,993,944 | A | 11/1999 | Honna et al. | |
| 6,019,809 | A | 2/2000 | Kahlbaugh et al. | |
| 6,066,235 | A | 5/2000 | Scheinberg | |
| 6,235,377 | B1 | 5/2001 | Dillon et al. | |
| 6,306,539 | B1 | 10/2001 | Zguris | |
| 6,420,626 | B1 | 7/2002 | Erspamer et al. | |
| 6,653,381 | B2 | 11/2003 | Thames et al. | |
| 6,695,148 | B2 | 2/2004 | Homonoff et al. | |
| 6,821,672 | B2 | 11/2004 | Zguris | |
| 6,860,917 | B2 | 3/2005 | Henrichsen et al. | |
| 6,936,554 | B1 | 8/2005 | Singer et al. | |
| 7,115,150 | B2 | 10/2006 | Johnson et al. | |
| 7,309,372 | B2 | 12/2007 | Kahlbaugh et al. | |
| 7,390,760 | B1 | 6/2008 | Chen et al. | |
| 7,510,630 | B2 | 3/2009 | Zilker | |
| 7,520,994 | B2 | 4/2009 | Dong et al. | |
| 7,655,070 | B1 | 2/2010 | Dallas et al. | |
| 7,717,975 | B2 | 5/2010 | Kalayci et al. | |
| 7,910,003 | B2 | 3/2011 | Ferrer et al. | |
| 7,918,913 | B2 | 4/2011 | Kalayci et al. | |
| 8,267,681 | B2 | 9/2012 | Gupta et al. | |
| 8,524,041 | B2 | 9/2013 | Gupta et al. | |
| 2001/0003082 | A1 | 6/2001 | Kahlbaugh et al. | |
| 2003/0008214 | A1 | 1/2003 | Zguris | |
| 2003/0082979 | A1 | 5/2003 | Bean et al. | |
| 2004/0116026 | A1 | 6/2004 | Kubose et al. | |
| 2004/0163170 | A1 | 8/2004 | Cooper et al. | |
| 2004/0163781 | A1 | 8/2004 | Hernandez-Munoa et al. | |
| 2005/0026526 | A1 | 2/2005 | Verdegan et al. | |
| 2005/0130031 | A1 | 6/2005 | Zguris | |
| 2006/0094320 | A1 | 5/2006 | Chen et al. | |
| 2006/0096263 | A1 | 5/2006 | Kahlbaugh et al. | |
| 2006/0096932 | A1 | 5/2006 | Dema et al. | |
| 2006/0266701 | A1 | 11/2006 | Dickerson et al. | |
| 2007/0039300 | A1 | 2/2007 | Kahlbaugh et al. | |
| 2007/0190319 | A1 | 8/2007 | Kalayci | |
| 2007/0227359 | A1 | 10/2007 | Choi | |
| 2008/0035103 | A1 | 2/2008 | Barris et al. | |
| 2008/0105629 | A1 | 5/2008 | Yang et al. | |
| 2008/0160856 | A1 | 7/2008 | Chen et al. | |
| 2008/0245037 | A1 | 10/2008 | Rogers et al. | |
| 2009/0221047 | A1 | 9/2009 | Schindler et al. | |
| 2009/0266759 | A1 | 10/2009 | Green | |
| 2010/0031940 | A1 | 2/2010 | Mosset et al. | |
| 2010/0176068 | A1 | 7/2010 | Dallas et al. | |
| 2010/0187171 | A1 | 7/2010 | Gupta | |
| 2010/0187712 | A1 | 7/2010 | Gupta et al. | |
| 2010/0233048 | A1 | 9/2010 | Dallas et al. | |
| 2011/0005394 | A1 | 1/2011 | Joriman et al. | |
| 2011/0017155 | A1 | 1/2011 | Jacob | |
| 2011/0048228 | A1 | 3/2011 | Handley et al. | |
| 2012/0312488 | A1 | 12/2012 | Gupta et al. | |
| 2013/0340962 | A1 | 12/2013 | Gupta et al. | |

FOREIGN PATENT DOCUMENTS

| | | |
|---|---|---|
| DE | 102004046669 | 3/2006 |
| DE | 102006013170 | 9/2007 |
| DE | 200610001317 | 9/2007 |
| DE | 112010000801 | 9/2012 |
| EP | 109282 | 5/1984 |
| EP | 1746209 | 1/2007 |
| EP | 1905877 | 4/2008 |
| FR | 1405536 | 7/1965 |
| JP | 57178842 | 11/1982 |
| JP | 61275495 | 12/1986 |
| JP | 62033514 | 2/1987 |
| JP | 07299315 | 11/1995 |
| JP | 08-243323 | 9/1996 |
| JP | 09-170199 | 6/1997 |
| JP | 10212683 | 8/1998 |
| JP | 2007090292 | 4/2007 |
| JP | 2012516399 | 7/2012 |
| WO | 9516070 | 6/1995 |
| WO | WO-9516070 | 6/1995 |
| WO | 0075427 | 12/2000 |
| WO | WO-0075427 | 12/2000 |
| WO | WO-03048452 | 6/2003 |
| WO | WO-2006115796 | 2/2006 |
| WO | WO-2006032706 | 3/2006 |
| WO | WO-2006049664 | 5/2006 |
| WO | WO-2008103736 | 8/2008 |
| WO | WO-2009088647 | 7/2009 |
| WO | WO-2010088403 | 8/2010 |

OTHER PUBLICATIONS

"Communication Pursuant to Rules 161(1) and 162 EPC", from EP Application No. 12704964.1, mailed Sep. 10, 2013, 2 pages.

"International Preliminary Report on Patentability", from PCT Application No. PCT/2012/022644, mailed Aug. 8, 2013, 7 pages.

"International Preliminary Report on Patentability", from PCT Application No. PCT/2012/023147, mailed Aug. 8, 2013, 7 pages.

"Office Action", from MX Application No. MX/a/2011/007775, agent letter mailed Jul. 2, 2013, 2 pages.

"Non-Final Office Action", mailed Jul. 23, 2012 in U.S. Appl. No. 12/694,913, "Fibrous Media " (38 pages).

"First Office Action", for Application Serial No. 201080005942.9, Mar. 25, 2013 (11 pages).

Communication Pursuant to Article 94(3) EPC, for European Patent Application No. 10702968.8, mailed Mar. 18, 2014 (4 pages).

"Microfiber", http://depts.washington.edu/frcg/MRSA.html, Nov. 2011 (2 pages).

"Non-Final Office Action", for CN Application No. 201080005942.9, mailed Apr. 4, 2014 (5 pages).

"Non-Final Office Action", for U.S. Appl. No. 12/694,913, mailed Apr. 24, 2014 (17 pages).

"JP07299315 English Abstract" Masakatsu Kujira, et al. (1 page).

"JP62033514 English Abstract" Takahashi Wataru, et al. (1 page).

"Non Final Office Action Received", Non-Final Office Action mailed Dec. 15, 2011 in co-pending U.S. Appl. No. 12/694,935,"*Systems and Methods for Meat Processing*," , 44 pages.

(56) References Cited

OTHER PUBLICATIONS

"Notice of Allowance", mailed May 8, 2012 in co-pending U.S. Appl. No. 12/694,935, titled "*Method and Apparatus for Forming a Fibrous Media*," (10 pages).
"PCT International Search Report and Written Opinion", from International Application No. PCT/US2012/023147, mailed May 2, 2012, pp. 1-11.
"PCT International Search Report and Written Opinion", from International Application No. PCT/US2012/022644, mailed Apr. 10, 2012, pp. 1-12.
"PCT Notification Concerning Transmittal of International Preliminary Report on Patentability", from International Application No. PCT/US2010/022427, corresponding to U.S. Appl. No. 12/694,913, mailed Aug. 11, 2011, pp. 12 , 12 Pgs.
"Response to Non-Final Office Action", mailed Dec. 15, 2011, in co-pending U.S. Appl. No. 12/694,935, filed Mar. 15, 2012 (12 pages).
Haider, et al., "Board and Packaging Headbox Technology for the 21st Century", African Pulp and Paper Week: Adding Value in a Global Industry, International Convention Centre, Durban (Oct. 11, 2002), http://tappsa.co.za/archive/APPW2002/Title/Board_and_packaging_headbox-te/board_an . . . , (13 pages).
"Communication pursuant to Article 94(3) EPC", European Examination Report, from the European Patent Office in EP Patent Application No. 10702968.8-1217, corresponding to U.S. Appl. No. 12/694,913, mailed Sep. 25, 2012, (pp. 1-4).
"Final Office Action", mailed Dec. 26, 2012 in co-pending U.S. Appl. No. 12/694,913, "Fibrous Media," (19 pages).
"First Office Action", from EP Application No. 10702968.8, corresponding to U.S. Appl. No. 12/694,913, mailed Sep. 25, 2012, (pp. 1-51).
"Response to Communication pursuant to Article 94 (3) EPC", Response to European Examination Report, dated Sep. 25, 2012, Filed in the European Patent Office on Feb. 5, 2013 for EP Patent Application No. 10702968.8-1217, corresponding to U.S. Appl. No. 12/694,913, (pp. 1-16).
"Response to Final Office Action", mailed Dec. 26, 2012 in co-pending U.S. Appl. No. 12/694,913, filed Feb. 26, 2013 (20 pages).
"Response to Non-Final Office Action", mailed Jul. 23, 2012 in co-pending U.S. Appl. No. 12/694,913, filed Oct. 23, 2012 (17 pages).
Notice of Allowance from U.S. Appl. No. 13/589,908, mailed Mar. 21, 2013, 26 pgs.
"Non-Final Office Action", for Chinese Patent Application No. 201080005942.9, mailed Nov. 1, 2013 (10 pages).
"File History for co-owned, co-pending U.S. Appl. No. 12/694,913", As of Feb. 7, 2014, Entitled "Fibrous Media," filed Jan. 27, 2010 (400 pages).
File History for co-owned, co-pending U.S. Appl. No. 14/011,337, As of Feb. 7, 2014, Entitled "Method and Apparatus for Forming a Fibrous Media" filed Aug. 27, 2013 (230 pages).
"Official Action", for Japanese Patent Application No. 2011-548304, mailed Nov. 25, 2013 (3 pages).
"Final Rejection", for Japanese Patent Application No. 2011548304, mailed Jul. 31, 2014 (6 pages) with English translation.
"Final Office Action," for U.S. Appl. No. 14/011,337, mailed Nov. 19, 2014 (72 pages).
"Final Office Action," for U.S. Appl. No. 12/694,913, mailed Nov. 12, 2014 (30 pages).
"First Office Action," for Chinese Patent Application No. 201280006182.2 mailed Nov. 2, 2014 (20 pages) with English translation.
"Non-Final Office Action," for CN Application No. 201080005942.9 , mailed Oct. 20, 2014 (9 pages).
"Non-Final Office Action," for U.S. Appl. No. 13/361,527, mailed on Nov. 25, 2014 (51 pages).
"Communication Pursuant to Article 94(3) EPC," for European Patent Application No. 12702726.6, mailed Jan. 22, 2015 (4 pages).
"Non Final Office Action," for Chinese Patent Application No. 2012800056932, mailed May 21, 2015 (15 pages) with English translation.
"Response to Communication Pursuant to Article 94(3) EPC," for European Patent Application No. 12702726.6, filed May 29, 2015 (43 pages).

* cited by examiner 200
202
201

210
212
211
213

220
222
224
221
225

METHOD AND APPARATUS FOR FORMING A FIBROUS MEDIA

This application claims priority to U.S. Provisional Patent Application No. 61/437,218, filed Jan. 28, 2011, the contents of which are herein incorporated by reference in their entirety.

FIELD OF THE INVENTION

The field of the invention is apparatuses and methods or processes for making nonwoven fibrous media comprising controllable characteristics within the media. The term medium (plural media) refers to a web made of fiber having variable or controlled structure and physical properties. The media can be used in filtration products and processes. The media are formed using cylinder forming apparatuses.

BACKGROUND

The cylinder former was originally developed for papermaking, but is generally useful for forming fibrous webs from fiber slurries. It can be used as a standalone apparatus for forming a single ply sheet of fibers or in series to form a multiply web. Cylinder formers include a horizontally situated cylinder with a wire or plastic cloth surface that rotates in a vat containing a constantly refreshed dilute slurry of fibers, wherein the liquid carrying the slurry is typically water. The water associated with the slurry is drained through the cylinder and a layer of fibers is deposited on the wire or cloth. The drainage rate, in some designs, is determined by the slurry properties and water level inside the cylinder such that a pressure differential is formed. As the cylinder turns and water is drained, the fibrous layer that is deposited on the cylinder is peeled off of the wire or cloth and continuously transferred to a soft rubber couch roll. Further plys may be added, or additional treatments including heating or other means of drying the web are then employed depending on the ultimate intended end use. Cylinder formers are currently employed in the industry to form a variety of nonwoven fibrous webs. Wood based cellulose fibers are only one type of fiber that can be suitably dewatered to form a fibrous web; other natural fibers such as cotton, synthetic thermoplastic fibers such as polyolefin, polyester, or nylon fibers, inorganic fibers such as glass fibers, and the like may suitably employed to form fibrous webs using a cylinder former. Other materials, for example particles, latex-based binder resins, and the like are often included in slurries to form fibrous webs for a variety of industrially useful applications.

One important aspect of the construction of cylinder formers is the location and flow of the slurry as it is applied to the rolling cylinder. In some types of cylinder formers, the slurry is applied using a vat situated horizontally, such that the lower half of the cylinder is effectively immersed in the slurry. As the cylinder turns, fresh slurry is continuously pumped through the vat. A counterflow vat has slurry pumped into the vat such that the flow direction is opposite to the direction of the cylinder's rotation. A uniflow vat has slurry pumped into the vat such that that flow direction is the same as the direction of the cylinder's rotation. Each type of flow system has benefits and drawbacks that are well known to those of skill in the art. In another type of cylinder former, known as the "dry vat," slurry is applied substantially vertically along the cylinder in the same direction as the cylinder's rotation. The area of the cylinder contacting the slurry, called the "forming area," is restricted compared to that of other vat designs. Suction formers are dry vat type formers that have a very restricted forming area and utilize vacuum dewatering inside of the cylinder. The greater rate of water removal afforded by vacuum dewatering facilitates increased line speed relative to "gravity" type water drainage. Pressure formers are another dry vat type variation that employ a pressurized slurry instead of vacuum suction as a means to control the pressure differential.

In all of these constructions, single slurries are employed in single pass operations to form single ply fibrous layers of variable thickness. Multiply webs are formed by disposing more than one cylinder former in series, wherein as a fibrous mat is formed, it is combined with one or more additional mats formed on separate cylinder(s). In some cases, to form a multiply web, a first layer formed is couched on a second cylinder, and two layers are picked by another couch roll and transferred to a third stage cylinder. Each ply formed will have a distinct boundary, because each ply is completely formed prior to application of the next slurry or ply. However, for some applications it would be desirable to have a gradient of characteristics in transition from one ply to the next. For example, fibrous media having pore size gradients are advantageous for, among other applications, particulate filtration, where the filter otherwise can become clogged in the most upstream layers, thus shortening the lifetime of the filter. In some particulate filtration applications, it has been observed that the presence of interface(s) between layers of the filter element is where trapped particulate tends to build up. In some such applications, sufficient buildup between layers results in filter failure.

Additionally, fibrous media having a gradient of such characteristics as fiber chemistry, fiber diameter, crosslinking or fusing or bonding functionality, presence of binder or sizing, presence of particulates, and the like would be advantageous in many diverse applications. Such gradients can give rise to, for example, gradients in permeability, retention of particulates, pressure drop, species filtration, and the like when employed in filtration applications. Gradients of materials and physical attributes would be advantageous when provided through the thickness of a fibrous media, or over another dimension such as crossweb width or length of a fibrous media. Such gradients have not previously been known to be possible in conjunction with the ease of forming and compact design of a cylinder forming apparatus.

There is a need in the industry to provide a fibrous medium having a true gradient of materials, such as fibers of varying chemistry, diameter, aspect ratio, and the like using a cylinder forming apparatus. There is a need in the industry to provide a fibrous medium having a true gradient of other materials, such as resins, adhesives, crosslinkers, binders, particulates, and the like throughout the fibrous medium using a cylinder forming apparatus. There is a need in the industry for providing such gradients either through the thickness or the crossweb or downweb direction of a length of fibrous media using a cylinder forming apparatus. There is a need in the industry to form such constructions with sufficient ease and efficiency to make the products commercially and economically viable for a range of applications using a cylinder forming apparatus. There is a need in the industry to enable a gradient fibrous medium to be formed in single pass using a cylinder forming apparatus.

SUMMARY

Disclosed herein is an arcuate mixing partition designed to produce controlled mixing of two flow streams applied to a cylinder forming apparatus. The arcuate mixing partition is concave with respect to the cylinder portion of the cylinder forming apparatus and is situated proximal to the cylinder in the cylinder forming apparatus. The arcuate mixing partition is either a solid partition or a partition having one or more openings to control mixing of two separate flow streams. At least one of the two flow streams contains fibers. The flow streams are applied to a cylinder forming apparatus with the arcuate mixing partition disposed between at least a portion of the flow streams. As the flow streams are applied to the cylinder they are mixed in a controlled fashion prior to, during, or both prior to and during the drainage of water through the cylinder to result in a non-woven web having a gradient distribution. In some embodiments, the arcuate mixing partition has a radius of curvature corresponding to a circle concentric to the cylinder of the cylinder former. In embodiments, the arcuate mixing partition spans the length of the cylinder. The arcuate mixing partition facilitates, in various embodiments, the formation of gradients throughout the thickness of the nonwoven web or in the crossweb direction of the web, wherein the gradient is a gradient of fibers of varying chemistry, diameter, aspect ratio, and the like; or of resins, adhesives, crosslinkers, binders, particulates, and the like. In some embodiments, the flow streams flow in the same direction; in some embodiments the flow streams flow in opposite directions. In some embodiments, the flow streams are subjected to pressure in order to facilitate mixing and drainage of liquid from the flow streams. In some embodiments, the flow streams are subjected to vacuum suction wherein a source of vacuum is situated within the forming cylinder. In some embodiments, the arcuate mixing partition has adjustable openings. In some embodiments the arcuate mixing partition is detachable from the cylinder former. In some such embodiments, a standard single flow stream cylinder former is retrofitted with an arcuate mixing partition and a source of a second flow stream. In some such embodiments, the second flow stream source and the arcuate mixing partition are part of a single retrofitted attachment; in some such embodiments the attachment is detachable.

DETAILED DESCRIPTION

1. Definitions

Figure 1:
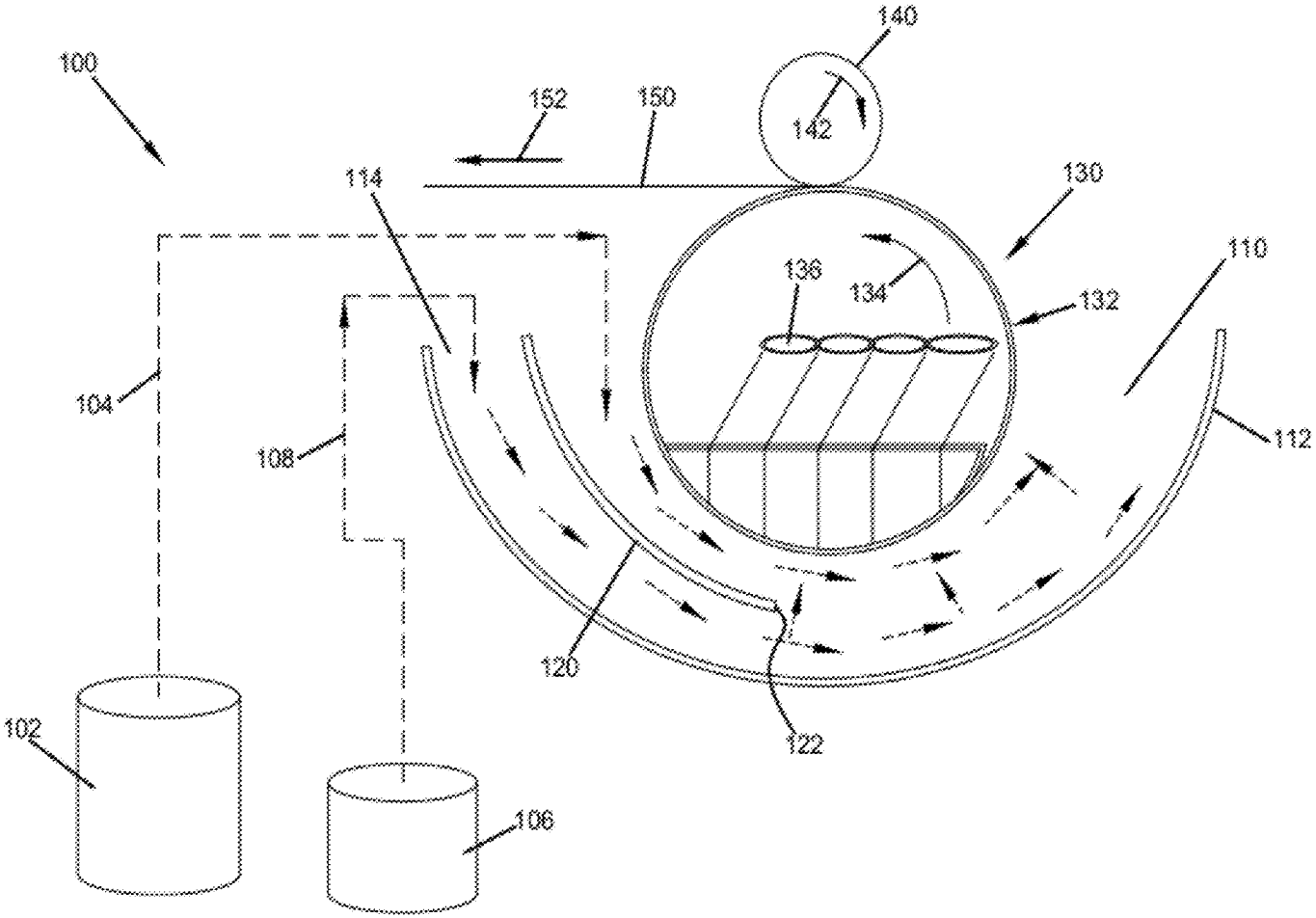
FIGS. 1, 3, and 10-16 are schematic, partial cross-sectional views of various embodiments of apparatuses for making nonwoven webs.

For the purpose of this disclosure, the term "web" or "fibrous web" relates to a sheet-like or planar structure having a thickness of about 0.05 mm to an indeterminate or arbitrarily larger thickness. This thickness dimension can be 0.5 mm to 2 cm, 0.8 mm to 1 cm or 1 mm to 5 mm. Further, for the purpose of this patent application, the term "web" relates to a sheet-like or planar structure having a width that can range from about 2.00 cm to an indeterminate or arbitrary crossweb width. The length can be an indeterminate or arbitrary length. Such a web is flexible, machinable, pleatable and otherwise capable of forming into a filter element or filter structure. The web can have a gradient region and can also have a constant region For the purpose of this disclosure the term "fiber" indicates a large number of compositionally related fibers such that all the fibers fall within a range of fiber sizes or fiber characteristics that are distributed (typically in a substantially normal or Gaussian distribution) about a mean or median fiber size or characteristic.

For the purpose of this disclosure, the term "gradient" indicates that some property of a web varies typically in the crossweb or web thickness direction in at least a region of the web or in the web. The variation can occur from a first surface to a second surface or from a first edge to a second edge of the web. The gradient can be a physical property gradient or a chemical property gradient. The medium can have a gradient in at least one of the group consisting of permeability, pore size, fiber diameter, fiber length, efficiency, solidity, wettability, chemical resistance and temperature resistance. In such a gradient, the fiber size can vary, the fiber concentration can vary, or any other compositional aspect can vary. Further, the gradient can indicate that some filter property of the medium such as pore size, permeability, solidity and efficiency can vary from the first surface to the second surface. Another example of a gradient is a change in the concentration of a particular type of fiber from a first surface to a second surface, or from a first edge to a second edge. Gradients of physical properties, such as wettability, chemical resistance, mechanical strength and temperature resistance can be achieved where the web has gradients of fiber concentrations of fibers with different fiber chemistries. Such variation in composition or property can occur in a linear gradient distribution or non-linear gradient distribution. Either the composition or the concentration gradient of the fiber in the web or medium can change in a linear or non-linear fashion in any direction in the medium such as upstream, downstream etc.

The term "region" indicates an arbitrarily selected portion of the web with a thickness less than the overall web thickness, or with a crossweb length less than the overall crossweb length. Such a region is not defined by any layer, interface or other structure but is arbitrarily selected only for comparison with similar regions of fiber etc. adjacent or proximate to the region in the web. In this disclosure a region is not a discrete layer. In the region, in some embodiments a first and second fiber can comprise a blend of compositionally different fibers and the region is characterized by a gradient in a portion of the thickness of the medium. In the fibrous media, the regions can have a variety of thicknesses. Such a media can have a thickness that ranges from about 0.3 mm to 5 mm, 0.4 mm to 3 mm, 0.5 mm to 1 mm, at least 0.05 mm or greater. Such a media can have a gradient region that encompasses about 1% to about 99% of the thickness of the medium. Alternatively, the gradient region can comprise from about 5% to about 95% of the thickness or crossweb length of the media. Still another aspect of the gradient of the media of the invention comprises a media wherein the gradient region is 10% to 80% of the thickness or crossweb length of the media. Still further another embodiment of the invention comprises a media wherein the thickness of the gradient region is from about 20% to about 80% of the thickness or crossweb length of the media overall. In similar fashion, in some embodiments the media comprises a constant region. As used herein, a "constant region" means a region of the media that does not have a gradient as the term gradient is used herein. In some embodiments, the constant region is about 1% of the thickness or crossweb length of the media, or between about 1% and 20% of the thickness or crossweb length of the media, or between about 5% and 20% of the thickness or crossweb length of the media, or between about 10% and 20% of the thickness or crossweb length of the media, or greater than 20% of the thickness or crossweb length of the media, or as much as 99% of the thickness or crossweb length of the media. For the purpose of this disclosure, the term "arcuate mixing partition" refers to an arcuate shaped, mechanical barrier that can separate a first flow stream from a second flow stream when disposed in a cylinder forming apparatus, but provide one or more open areas that in turn provide a controlled degree of mixing between the flow streams prior to the drainage of at least a portion of the liquid from the flow stream. The arcuate mixing partition is concave with respect to the cylinder portion of the cylinder forming apparatus and is situated proximal to the cylinder in the cylinder forming apparatus in non-touching relation thereto. In some embodiments, the arcuate mixing partition has the same radius of curvature as the cylinder. The arcuate mixing partition is either a solid partition or a partition having one or more openings to control mixing of two separate flow streams. Where the arcuate mixing partition is a solid partition, it nonetheless defines at least one opening to facilitate the mixing of the flow streams when situated within the cylinder forming apparatus, as will be described in more detail below.

For the purpose of this disclosure, reference is made to a "fiber". It is to be understood that this reference relates to a source of fiber. Sources of a fiber are typically fiber products, wherein large numbers of the fibers have similar composition diameter and length or aspect ratio. For example, thermoplastic fiber such as polyester or nylon fiber, bicomponent fiber, glass fiber, and other fiber types are provided in large quantity having large numbers of substantially similar fibers. Natural fibers, such as cellulose, are also employed. Such fibers are typically dispersed into a liquid, such as an aqueous phase, for the purpose of forming the media or webs of the invention.

As used herein, "flow stream" means a mixture of liquid and one or more additional materials. The mixture may be a slurry, a dispersion, or a solution; it may be heterogeneous or homogeneous in nature. In embodiments, the liquid is water. The one or more additional materials are, in various embodiments, one or more fibers, one or more particles such as activated carbon, nanotubes, zeolites, metals, metal oxides, or metal carbonates, fillers, and the like; one or more latex resins or other latex-delivered polymers or compounds; or one or more liquid soluble or dispersible chemicals such as pH adjusting agents, cosolvents, crosslinkers, surfactants, flame retardants, pigments or dyes, bleaches, preservatives, thermal stabilizers, and the like. In embodiments, two flow streams are employed in conjunction with the apparatuses and processes of the invention. Of the two flow streams, at least one contains fibers.

As used herein, the term "source" is a point of origin, such as a point of origin of a fluid flow stream comprising a fiber. One example of a source is a nozzle. Another example is a headbox. A "headbox" is a device configured to deliver a substantially uniform flow of furnish across a width. In some cases, pressure within a headbox is maintained by pumps and controls. For example, an air-padded headbox use an airspace above the furnish as a means of controlling the pressure. In some cases, a headbox also includes rectifier rolls, which are cylinders with large holes in them, slowly rotating within an air-padded headbox to help distribute the furnish. In hydraulic headboxes, redistribution of furnish and break-up of flocs is achieved with banks of tubes, expansion areas, and changes of flow direction.

"Machine direction" is the direction that a web travels through an apparatus, such as an apparatus that is producing the web. Also, the machine direction is the direction of the longest dimension of a web of material. In some cases, the machine direction is also referred to as the "y direction."

"Cross web direction" is the direction perpendicular to the machine direction. Depending on machine settings, the regions are formed in the process of the invention typically by forming a wet layer on a forming wire and then removing liquid leaving the fiber layer for further drying and other processing. In some cases, the crossweb direction is also referred to as the "x direction."

The terms "filter media" or "filter medium", as those terms are used in the disclosure, relate to a layer having at least minimal permeability and porosity such that it is at least minimally useful as a filter structure and is not a substantially impermeable layer such as conventional paper, coated stock or newsprint made in a conventional paper making wet laid processes.

2. Description of Representative Embodiments

In order to provide context for further discussion of the methods or processes and apparatuses of the invention, representative embodiments of apparatuses of the invention are now described. In FIG. 1, a cylinder former apparatus 100 includes a first source 102 of a first flow stream 104 and a second source 106 of a second flow stream 108. In some embodiments, the first flow stream 104 includes a first type of fiber, and the second flow stream 108 includes second type of fiber. The flow streams 104, 108 enter into vat 110, defined by vat wall 112, at opening 114. Disposed inside vat 110 is arcuate mixing partition 120 having distal end 122, and cylinder 130. The first flow stream 104 enters vat 110 at first side 114 between arcuate mixing partition 120 and cylinder 130. The second flow stream 108 enters vat 110 at first side 114 between vat wall 112 and arcuate mixing partition 120. The two flow streams 104, 108 become partially mixed as they flow past the distal end 122 of arcuate mixing partition 120. As the flow streams 104, 108 mix, cylinder 130 having perforate surface 132 drains liquid from the combined flow stream to form nonwoven web 150. As the nonwoven web 150 forms, it is peeled away from cylinder 130 and is urged in direction 152 by the action of cylinder 130 rotating in direction 134 against couch roll 140 rotating in direction 142. Between cylinder 130 and couch roll 140, web 150 is contacted by a moving felt (not shown) that in turn contacts couch roll 140. The felt carries web 150 to other apparatuses (not shown) for subsequent processing and/or windup steps. In some embodiments, couch roll 140 together with cylinder 130 form a pressurized nip area such that web 150 is squeezed as it leaves cylinder 130 on the moving felt. In other embodiments, no pressure is applied to web 150 as it is peeled away from cylinder 130 and onto the moving felt by the action of couch roll 140. It will be understood that the operator of the machine will select the gap or lack thereof between cylinder 130 and couch roll 140 to impart optimized physical properties in the media depending on the intended end use.

In embodiments where the first flow stream 104 includes a first type of fiber, and the second flow stream 108 includes second type of fiber, the resulting non-woven web 150 has a gradient distribution of the second type of fiber throughout the thickness of the web, or in a region of the web. The web 150 is optionally further processed, subjected to one or more steps wherein additional fibers, treatments, or other operations are carried out; in some embodiments the nonwoven web is heated to dry and/or partially melt one or more of the fibers, thereby fusing the nonwoven web between fibers.

In some embodiments of FIG. 1, the cylinder 130 further includes optional suction apparatus 136 that is engaged during web formation to suction liquid through perforate surface 132. The use of the suction apparatus increases the achievable speed of web formation of apparatus 100. In some embodiments, the cylinder 130 of FIG. 1 is rotated in direction 134 as shown. Such embodiments are referred to as "uniflow" embodiments when employed with the flow direction of flow streams 104. In other embodiments, the cylinder 130 is rotated opposite to the direction 134 as shown in FIG. 1. Such embodiments are referred to as "counterflow" embodiments when employed with the flow direction of flow streams 104.

In some embodiments, the apparatus of FIG. 1 is a cylinder former that is built with an arcuate mixing partition integral to the apparatus. In other embodiments the cylinder former is a conventional type former that is retrofitted with the arcuate mixing partition of the invention. In some of these embodiments, the arcuate mixing partition is removable.

In some embodiments of the apparatus and method embodied in FIG. 1, the two flow streams 104, 108 contain two different fibers that differ in diameter, length, chemistry, or a combination thereof. In other embodiments the first flow stream 104 contains fibers and second flow stream 108 contains one or more crosslinkers, fiber treatments, binder latexes, sizing, particulates, and the like. In still other embodiments, the two flow streams are blends of one or more fibers and one or more crosslinkers, fiber treatments, binder latexes, sizing, particulates, and the like. It will be appreciated that as long as one flow stream contains a fiber, any combination of materials useful in forming a fibrous web having a gradient of one or more materials through at least a region of the web is suitably employed in conjunction with the apparatuses and methods of the invention such as in the embodiment exemplified by FIG. 1.

The arcuate mixing partition 120 is adapted to cooperate with flow streams 104, 108 vat wall 112, and cylinder 130 with various geometries and spacing in order to manipulate the flow streams to obtain a desired level and location of mixing in further cooperation with drainage of liquid to form the web 150. In embodiments, partition 120 has the same radius of curvature as the cylinder 130; in other embodiments the radius of curvature differs from that of the cylinder. In embodiments, the gap between the partition 120 and the cylinder 130, wherein first flow stream 104 flows, is adjusted to be the same as the gap between the vat wall 112 and the partition 120, wherein the second flow stream 108 flows. In other embodiments, the gap defined by the partition 120 and the cylinder 130 is different from the gap defined by the gap between the vat wall 112 and the partition 120. In still other embodiments, the two gaps are adjustable depending on the nature of the gradient media desired, concentration of fiber in the one or more flow streams, or other processing parameters. Further, the shape of the arcuate mixing partition 120 is variable to allow specific gradient structures to be achieved in the web, as will now be discussed in detail further herein.

Figures 2A, 2B, 2C:
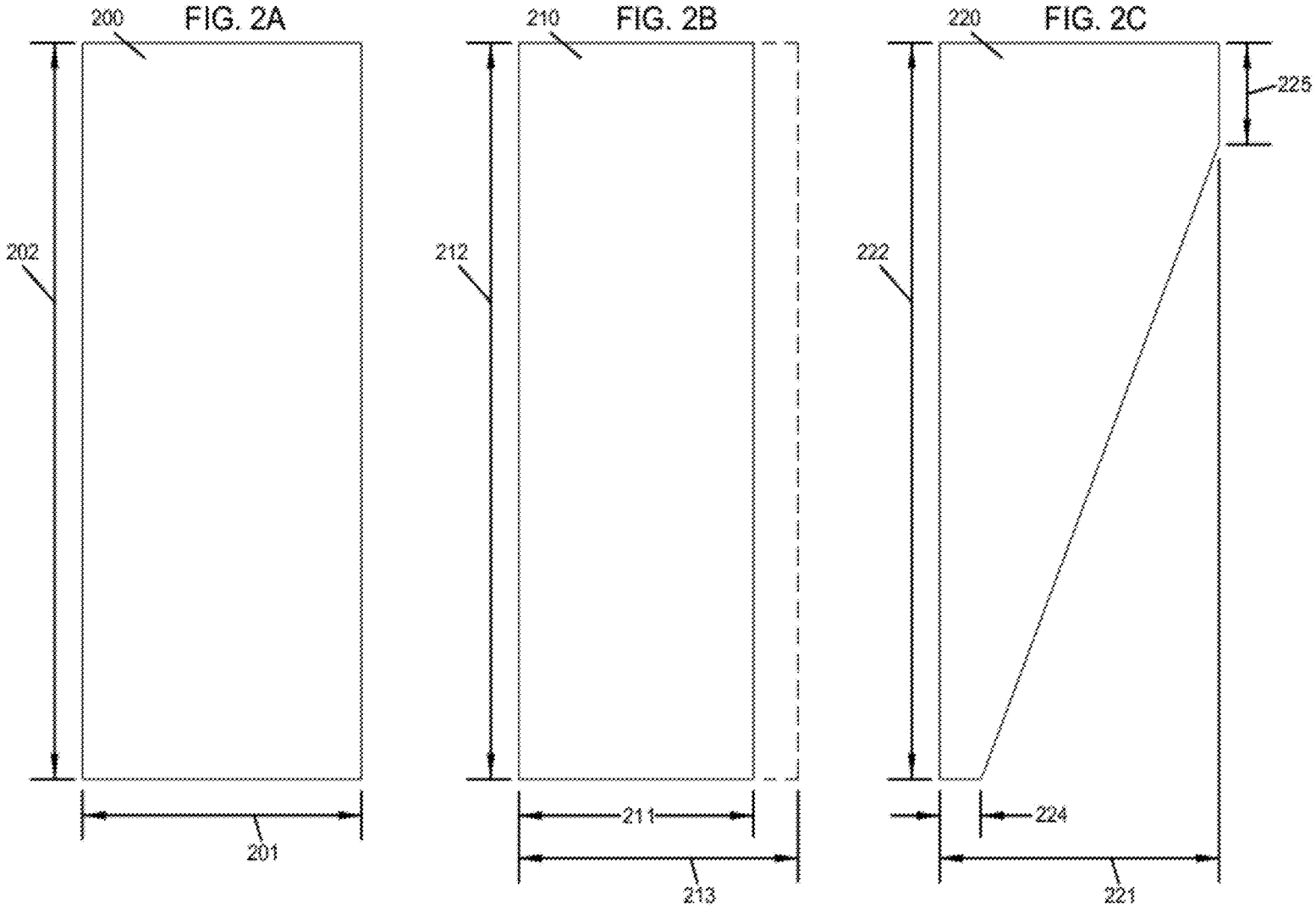
FIGS. 2A, 2B, 2C and 4-9 are top views of exemplary configurations of flattened mixing partitions of the invention.

FIG. 2A-C shows three exemplary embodiments of the arcuate mixing partition design that may be employed in various embodiments in the cylinder forming apparatuses such as the one shown in FIG. 1, wherein each arcuate mixing partition shape is shown flattened in order to more easily illustrate its design. It will be appreciated that many other designs are also possible. FIG. 2A shows partition design 200 having width 201 and length 202. Width 201 corresponds to the length of the cylinder 130 of FIG. 1, that is, the crossweb dimension of the web 150 formed by the apparatus 100 of FIG. 1. Length 202 corresponds to a length selected by the user of the apparatus 100 of FIG. 1, such that the length 202 spans less than the entire flow path of flow stream 108 through vat 110 in FIG. 1 when partition design 200 is employed as the arcuate mixing partition 120; other than this, the exact length of partition design 200 is not limited. In embodiments where partition design 200 is employed in a cylinder forming apparatus such as that of FIG. 1, the only contact between the two flow streams 104, 108 as shown in FIG. 1 is at the distal end 122 of the arcuate mixing partition 120. In such embodiments, gradient fibrous webs can be formed only through the thickness of the web.

FIG. 2B shows an arcuate mixing partition 210 that has been flattened to more easily illustrate its design, which in some embodiments accomplishes controlled mixing of the two flow streams in the crossweb direction. The partition 210 has width 211 and length 212. Width 211 of partition 210 is equal to or less than the length of the cylinder 130 of FIG. 1, which is represented by 213 in FIG. 2B. Length 212 corresponds to a length selected by the user of the apparatus 100 of FIG. 1, such that the length 212 spans equal to or less than the entire flow path of flow stream 108 through vat 110 in FIG. 1 when arcuate mixing partition 210 is molded into an arcuate shape and employed as arcuate mixing partition 120 in FIG. 1; other than this, the length of partition 210 is not limited. In embodiments of the apparatus of FIG. 1 employing the arcuate mixing partition 210 of FIG. 2B in cylinder forming apparatus 100 of FIG. 1, contact between the two flow streams 104, 108 is at least in a portion of the crossweb direction.

FIG. 2C shows an arcuate mixing partition 220 that has been flattened to more easily illustrate its design, which in some embodiments accomplishes controlled mixing of the two flow streams in the crossweb direction. The partition 220 has initial width 221, length 222, and final width 224. The distance of final width 224 is less than initial width 221 and is selected by the user. Initial width 221 corresponds to the length of the cylinder 130 of FIG. 1. Length 222 corresponds to a length selected by the user of the apparatus 100 of FIG. 1, such that the length 222 spans equal to or less than the entire flow path of flow stream 108 through vat 110 in FIG. 1 when arcuate mixing partition 220 is employed in an arcuate shape; other than this, the length of arcuate mixing partition 220 is not limited. Arcuate mixing partition 220 further includes an optional length portion 225 wherein the width of the arcuate mixing partition is the same as initial width 221. The distance of the optional length portion 225 is selected by the user of the apparatus 100 in FIG. 1. In embodiments such as that of FIG. 2C, the contact between the two flow streams 104, 108 as shown in FIG. 1 is provided gradually in the crossweb direction, such that a crossweb gradient is provided. In such embodiments, when employed in a cylinder former such as that shown in FIG. 1, gradient fibrous webs are formed using arcuate mixing partition 220 through both the thickness of the web that is formed, and in the crossweb direction. Further variations of FIG. 2A-C will be readily apparent to one of skill in the art.

Figure 3:
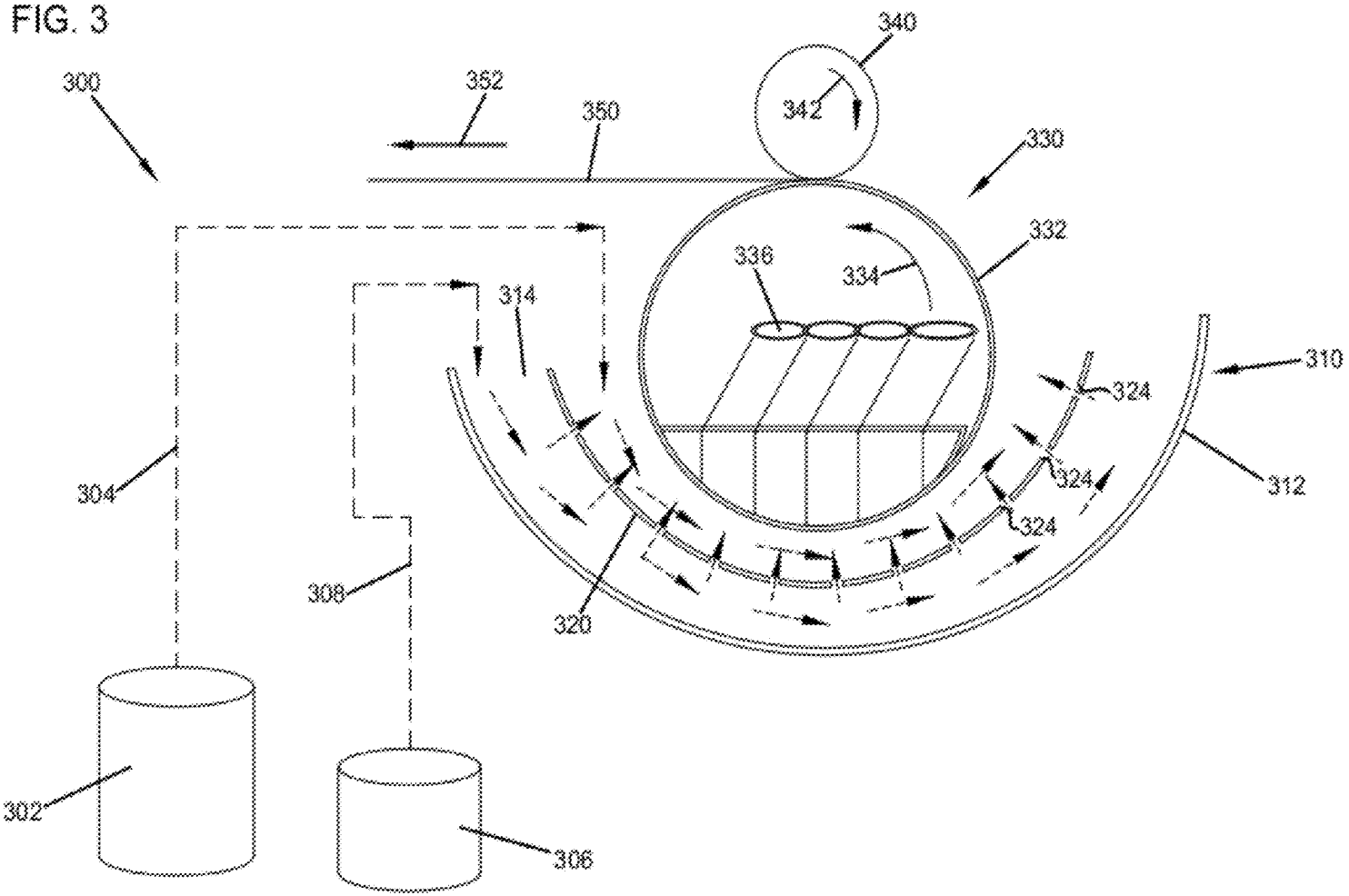

In FIG. 3, a cylinder forming apparatus 300 includes a first source 302 of a first flow stream 304 and a second source 306 of a second flow stream 308. In some embodiments, the first flow stream 304 includes a first type of fiber, and the second flow stream 308 includes second type of fiber. The flow streams 304, 308 enter into vat 310, defined by vat wall 312, at opening 314. Disposed inside vat 310 is arcuate mixing partition 320 having openings 324, and cylinder 330. The first flow stream 304 enters vat 310 at first side 314 between arcuate mixing partition 320 and cylinder 330. The second flow stream 308 enters vat 310 at first side 314 between vat wall 312 and arcuate mixing partition 320. The two flow streams 304, 308 become partially mixed as they flow through openings 324 of arcuate mixing partition 320. As the flow streams 304, 308 mix, cylinder 330 having perforate surface 332 drains liquid from the combined flow stream to form nonwoven web 350. As the nonwoven web 350 forms, it is peeled away from cylinder 330 by couch roll 340 and is urged in direction 352 by the action of cylinder 330 rotating in direction 334 against couch roll 340 rotating in direction 342. In embodiments where the first flow stream 304 includes a first type of fiber, and the second flow stream 308 includes second type of fiber, the resulting non-woven web 350 has a gradient distribution of the second type of fiber throughout the thickness of the web. The web 350 is optionally further processed, subjected to one or more steps wherein additional fibers, treatments, or other operations are carried out; in some embodiments the nonwoven web is heated to dry and/or partially melt one or more of the fibers, thereby fusing the nonwoven web between fibers.

In some embodiments of FIG. 3, the cylinder 330 further includes optional suction apparatus 336, that is engaged to suction liquid through perforate surface 332. Use of suction apparatus 336 increases the achievable speed of web formation of apparatus 300. The suction level of suction apparatus 336 as well as the percent area of the cylinder encompassing suction apparatus 336 is variable and is selected by the designer or operator of the cylinder former. In some embodiments, the cylinder 330 of FIG. 3 is rotated in direction 334 as shown. Such embodiments are referred to as "uniflow" embodiments when employed with the flow direction of flow streams 304. In other embodiments, the cylinder 330 is rotated opposite to the direction 334 as shown in FIG. 3. Such embodiments are referred to as "counterflow" embodiments when employed with the flow direction of flow streams 304.

In some embodiments of the apparatus and method embodied in FIG. 3, the two flow streams 304, 308 contain two different fibers that differ in diameter, length, chemistry, or a combination thereof. In other embodiments the first flow stream 304 contains fibers and second flow stream 308 contains one or more crosslinkers, fiber treatments, binder latexes, sizing, particulates, and the like. In still other embodiments, the two flow streams are blends of one or more fibers and one or more crosslinkers, fiber treatments, binder latexes, sizing, particulates, and the like. It will be appreciated that as long as one flow stream contains a fiber, any combination of materials useful in forming a fibrous web having a gradient of one or more materials is suitably employed in conjunction with the apparatuses and methods of the invention such as in the embodiment exemplified by FIG. 3.

The arcuate mixing partition 320 is adapted to cooperate with flow streams 304, 308, vat wall 312, and cylinder 330 with various geometries and spacing in order to manipulate the flow streams to obtain a desired level and location of mixing in further cooperation with drainage of liquid to form the web 350. In embodiments, partition 320 has the same radius of curvature as the cylinder 330; in other embodiments the radius of curvature differs from that of the cylinder. In embodiments, the gap between the partition 320 and the cylinder 330, wherein first flow stream 304 flows, is adjusted to be the same as the gap between the vat wall 312 and the partition 320, wherein the second flow stream 308 flows. In other embodiments, the gap defined by the partition 320 and the cylinder 330 is different from the gap defined by the gap between the vat wall 312 and the partition 320. In still other embodiments, the two gaps are adjustable depending on the nature of the gradient media desired, concentration of fiber in the one or more flow streams, or other processing parameters. Additionally, arcuate mixing partition 320 is adapted with apertures of various geometric configuration to allow specific gradient structures to be achieved in the web, as will now be discussed in detail further herein.

Figure 16:
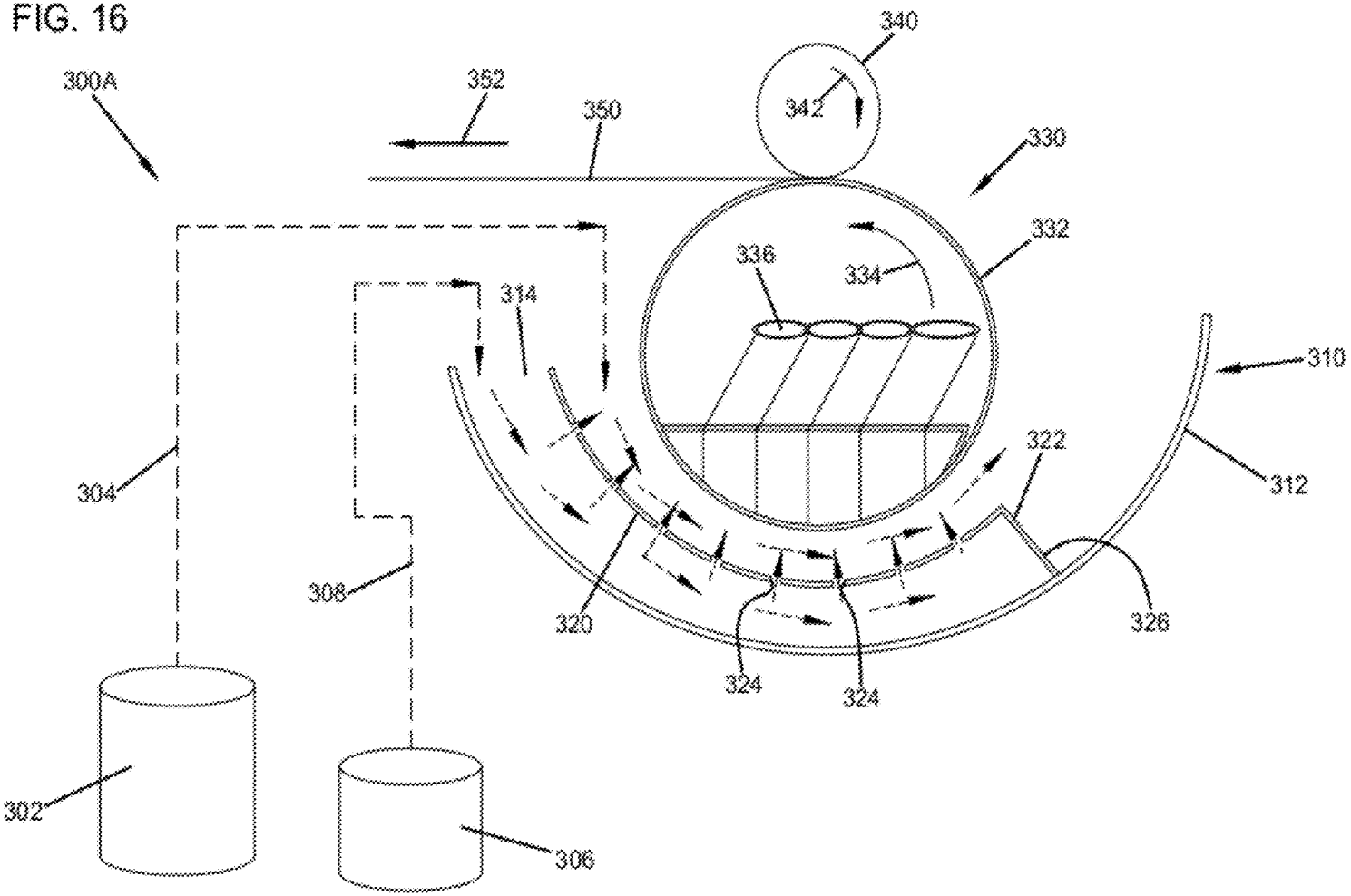

Another embodiment related to the embodiment of FIG. 3 is illustrated in FIG. 16. In FIG. 16, a cylinder forming apparatus 300A includes a first source 302 of a first flow stream 304 and a second source 306 of a second flow stream 308. The flow streams 304, 308 enter vat 310, defined by vat wall 312, at opening 314. Disposed inside vat 310 is arcuate mixing partition 320 and cylinder 330. Arcuate mixing partition 320 has openings 324 and distal end 322 having mixing partition wall 326. Partition wall 326 extends in the crossweb direction through vat 310 and traverses the length of cylinder 330. Therefore, partition wall 326 in conjunction with arcuate mixing partition 320 forms a chamber 320/326 that isolates flow stream 308 from flow stream 304 except where flow stream 308 flows through openings 324.

The first flow stream 304 enters vat 310 at first side 314 between chamber 320/326 and cylinder 330. The second flow stream 308 enters vat 310 at first side 314 between vat wall 312 and chamber 320/326. The two flow streams 304, 308 become partially mixed as flow stream 308 flows through openings 324 of chamber 320/326. In embodiments, the mixing partition wall 326 of chamber 320/326 equalizes the rate of flow of flow stream 308 in the crossweb direction. As the flow streams 304, 308 mix, cylinder 330 having perforate surface 332 drains liquid from the combined flow stream to form nonwoven web 350. As the nonwoven web 350 forms, it is peeled away from cylinder 330 by couch roll 340 and is urged in direction 352 by the action of cylinder 330 rotating in direction 334 against couch roll 340 rotating in direction 342. The web 350 is optionally further processed, subjected to one or more steps wherein additional fibers, treatments, or other operations are carried out; in some embodiments the nonwoven web is heated to dry and/or partially melt one or more of the fibers, thereby fusing the nonwoven web between fibers.

In embodiments, chamber 320/326 is connected to second source 306 in a configuration adapted to apply a pressure to flow stream 308 by second source 306. In some such embodiments, second source 306 is a pressurized source, and flow stream 308 is a pressurized flow stream. Pressurized flow stream 308 enters chamber 320/326 and traverses openings 324, as urged by pressure applied to chamber 320/326 by second source 306 and further as permitted by the dimensions of the openings 324. Pressurized flow stream 308 flows faster through openings 324 than flow stream 308 without pressure. In some such embodiments the desired degree of mixing of flow streams 304, 308 is achieved employing a higher flow rate of flow stream 304 than can be achieved without pressurizing flow stream 308. In some such embodiments, the desired degree of mixing of flow streams 304, 308 is achieved at a higher flow rate of flow stream 304 and at a higher rate of rotation of cylinder 330 than can be achieved without pressurizing flow stream 308. In some such embodiments, the overall speed of apparatus 300A in forming web 350 is faster than that of the apparatus 300 of FIG. 3.

FIGS. 4-9 show six exemplary embodiments of the arcuate mixing partition aperture designs that may be employed in various embodiments in the cylinder forming apparatuses such as the one shown in FIG. 3, wherein each arcuate mixing partition shape is shown flattened in order to more easily illustrate its design. It will be appreciated that many other designs will be envisioned by one of skill. Similarly to partition designs 2A, 2B, and 2C, the length and width of the partitions is variable. In each of FIGS. 4-9, the X direction corresponds to a distance equal to or less than the length of the cylinder 330 of FIG. 3, that is, the cross web (or crossweb) dimension of the web 350 formed by the apparatus 300 of FIG. 3. The Y direction corresponds to a length spanning a distance equal to at least some portion of flow stream 308 through vat 310 in FIG. 3, that is, the down web (or downweb) direction.

Figures 4, 5, 6:
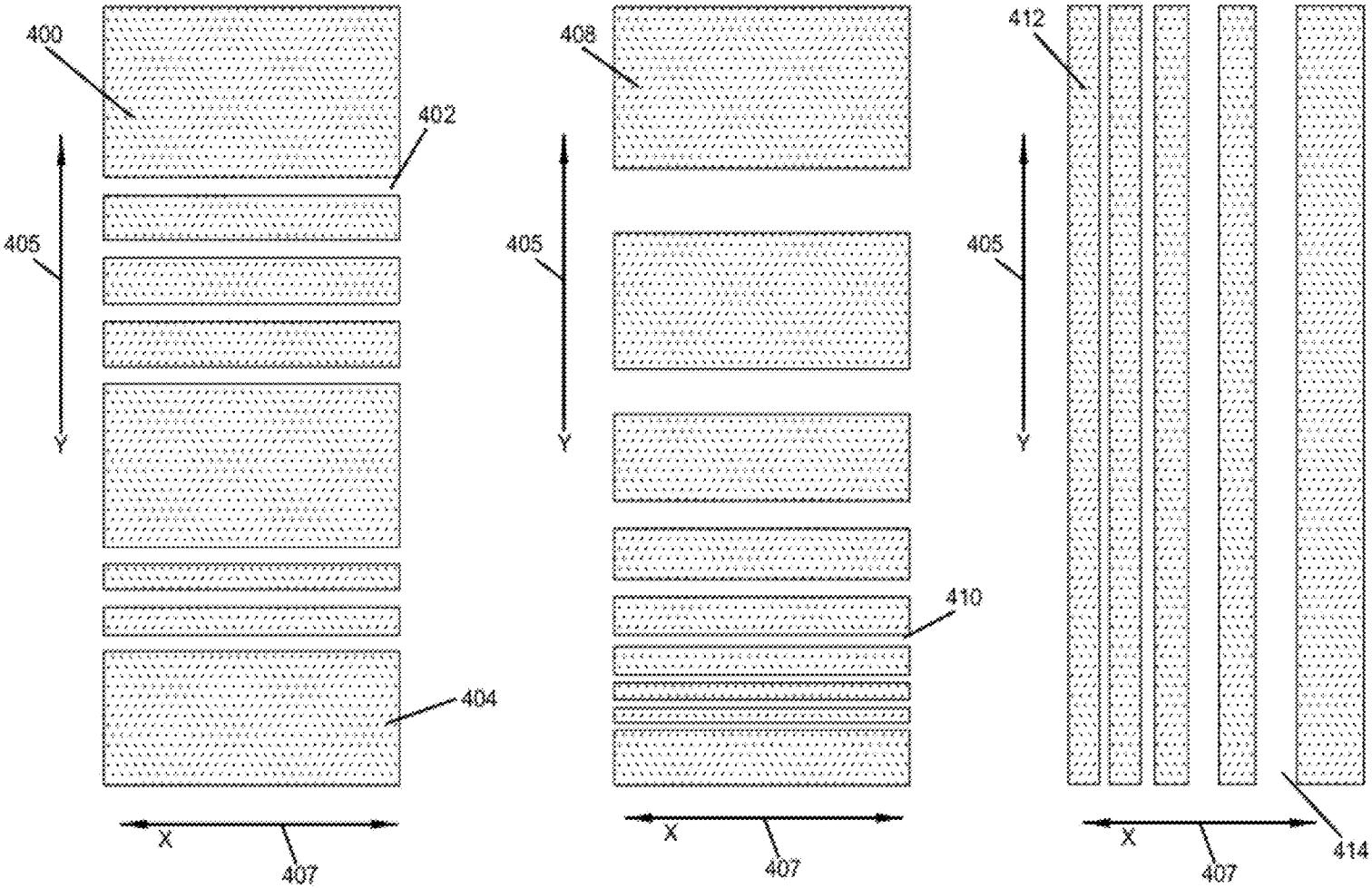

FIG. 4 shows partition design 400 having seven cross web slot-shaped openings 402 of substantially equal rectangular areas, spaced apart in the crossweb direction. Three slots 402 are evenly spaced from each other, and in a different portion of the partition design, four slots 402 are evenly spaced from each other. The partition design 400 includes an offset portion 404 adjacent to the first edge, where no openings are present.

FIG. 5 shows a partition design 408 having eight different crossweb rectangular openings 410 having six different sizes.

FIG. 6 shows a partition design 412 having four down web rectangular openings 414, each having an unequal area compared to the others. The size of the openings increases moving across the partition design 412 in the cross web direction. The partition design of FIG. 6 is one example that is configured to also provide a gradient in the crossweb direction of the web. In various embodiments, different combinations of openings shapes, for example, rectangular or circular, may be used on the same partition design.

The arcuate mixing partitions based on partition designs 400, 408 and 412 shown in FIGS. 4 to 6 can be constructed from individual rectangular pieces spaced to provide the rectangular openings.

Figure 7:
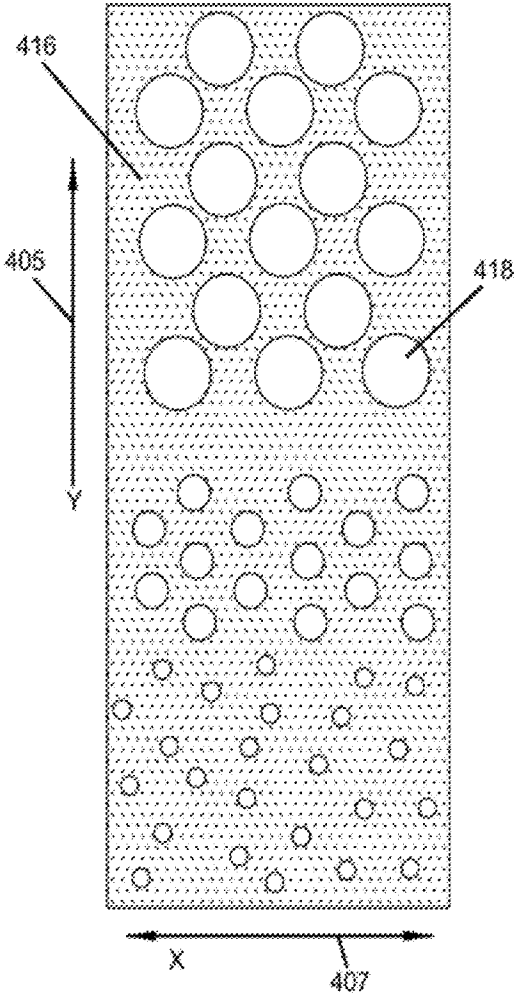

FIG. 7 shows a partition design 416 having circular openings 418. Three different sizes of circular openings are present in the mixing partition 416, where the size of the openings increases in the down web direction.

Figure 8:
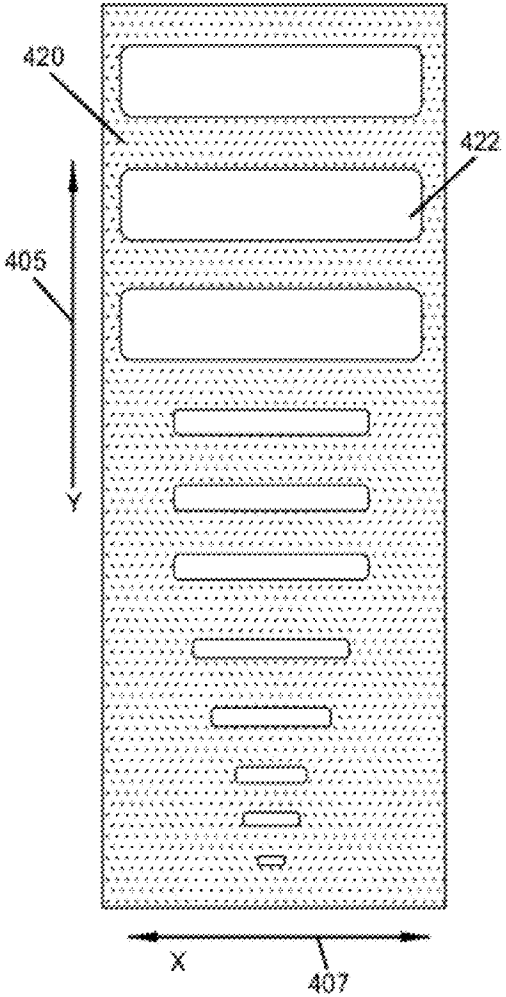

FIG. 8 shows a partition design 420 having rectangular openings 422 that are longer in the cross web direction and do not extend over the entire width of the mixing partition. The size of the rectangular openings increases in the down web direction.

Figure 9:
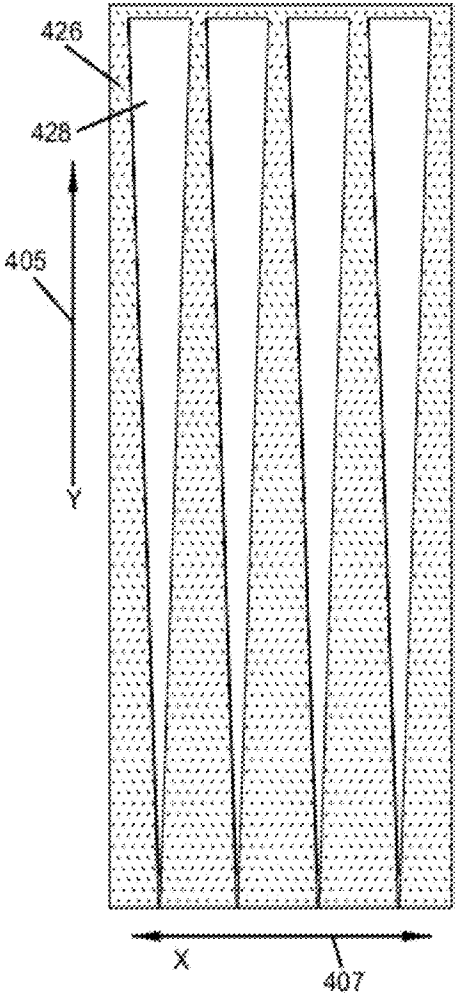

FIG. 9 shows a partition design 426 having four equal wedge-shaped openings 428 that are long in the down web direction and widen in the down web direction.

FIGS. 7 to 9 show partition designs 416, 420 and 426 that in some embodiments are formed from a single piece of base material with openings provided therein.

Each arcuate mixing partition configuration has a different effect on the mixing that occurs between the two flow streams. In some arcuate mixing partition examples, the variation in the size or shape of the openings occurs in the down web direction. When openings are positioned at the proximal end, or upstream end, of the arcuate mixing partition, the opening will enable mixing of the flow streams towards the bottom of the web. Openings at the distal end or downstream end of the arcuate mixing partition provide mixing of the furnishes closer to the top of the web. The size or area of the openings controls the proportion of mixing of the flow streams within the depth of the web. For example, smaller openings provide less mixing of the two flow streams, and larger openings provide more mixing of the two flow streams.

Further embodiments of cylinder molding apparatuses employing any of the arcuate mixing partitions, partition designs, types of flow streams, apparatus features and configurations, web treatments, and the like described above will now be discussed in FIGS. 10-15. Methods of using these apparatuses to form gradient fibrous media will also be discussed for each of the following embodiments.

Figure 10:
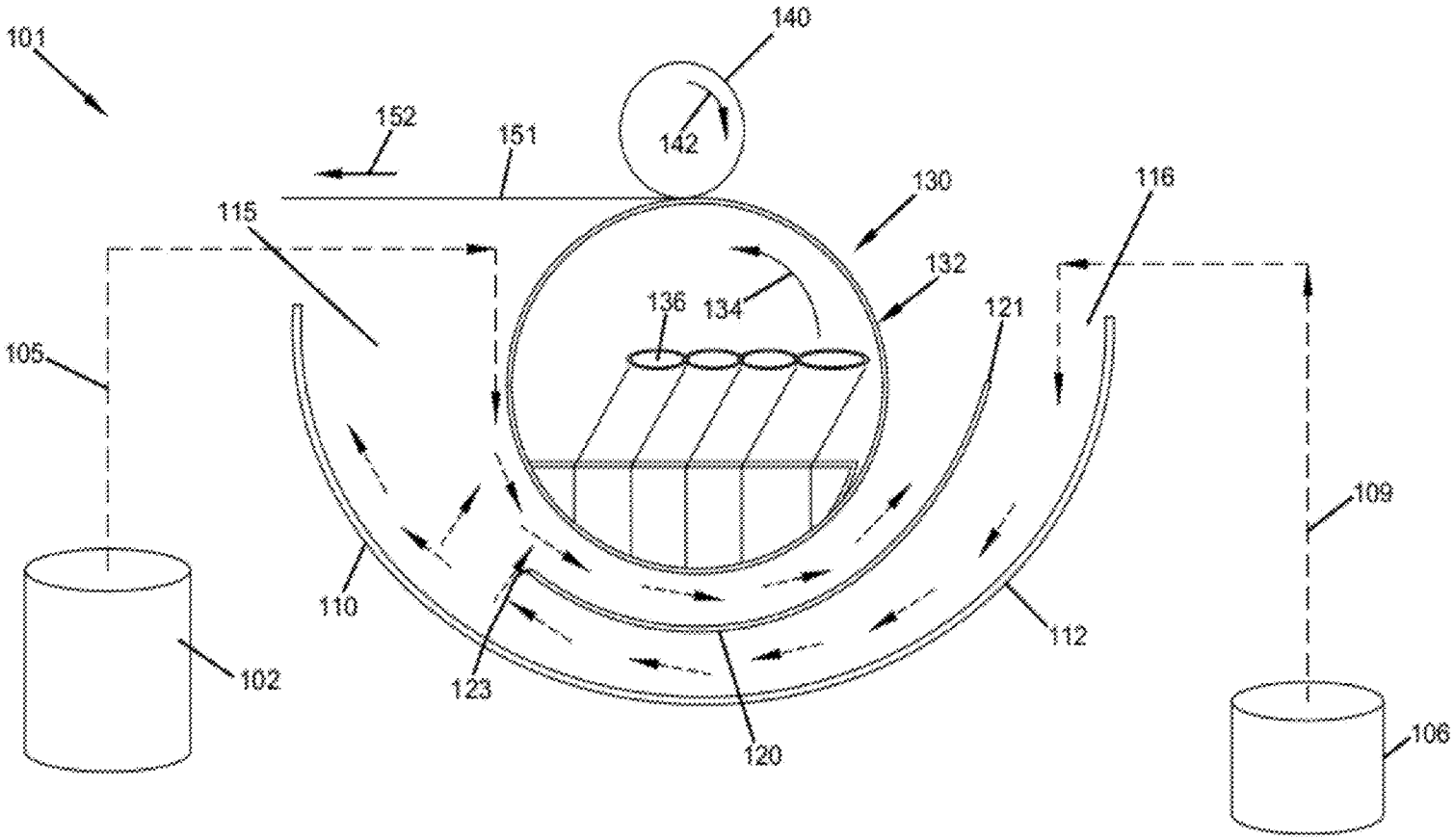

In FIG. 10, an apparatus 101 includes a first source 102 of a first flow stream 105 and a second source 106 of a second flow stream 109. Flow stream 105 enters vat 110 at opening 115. Flow stream 109 enters vat 110 at opening 116. Disposed inside vat 110 is arcuate mixing partition 120 having first end 121 and second end 123, and cylinder 130. The second flow stream 109 enters vat 110 at second end 116 between vat wall 112 and arcuate mixing partition 120. It will be appreciated that the two flow streams flow in generally opposing directions through portions of the vat 110. The two flow streams 105, 109 become partially mixed as they flow past the second end 123 of arcuate mixing partition 120. As the flow streams 105, 109 mix, cylinder 130 having perforate surface 132 drains liquid from the combined flow stream to form nonwoven web 151. As the nonwoven web 151 forms, it is peeled away from cylinder 130 by couch roll 140 and is urged in direction 152 by the action of cylinder 130 rotating in direction 134 against couch roll 140 rotating in direction 142.

In some embodiments of FIG. 10, the cylinder 130 further includes optional suction apparatus 136 that is engaged to suction liquid through perforate surface 132. Use of suction apparatus 136 increases the achievable speed of web formation of apparatus 100. The suction level of suction apparatus 136 as well as the percent area of the cylinder encompassing suction apparatus 136 is variable and is selected by the designer or operator of the cylinder former.

Figure 11:
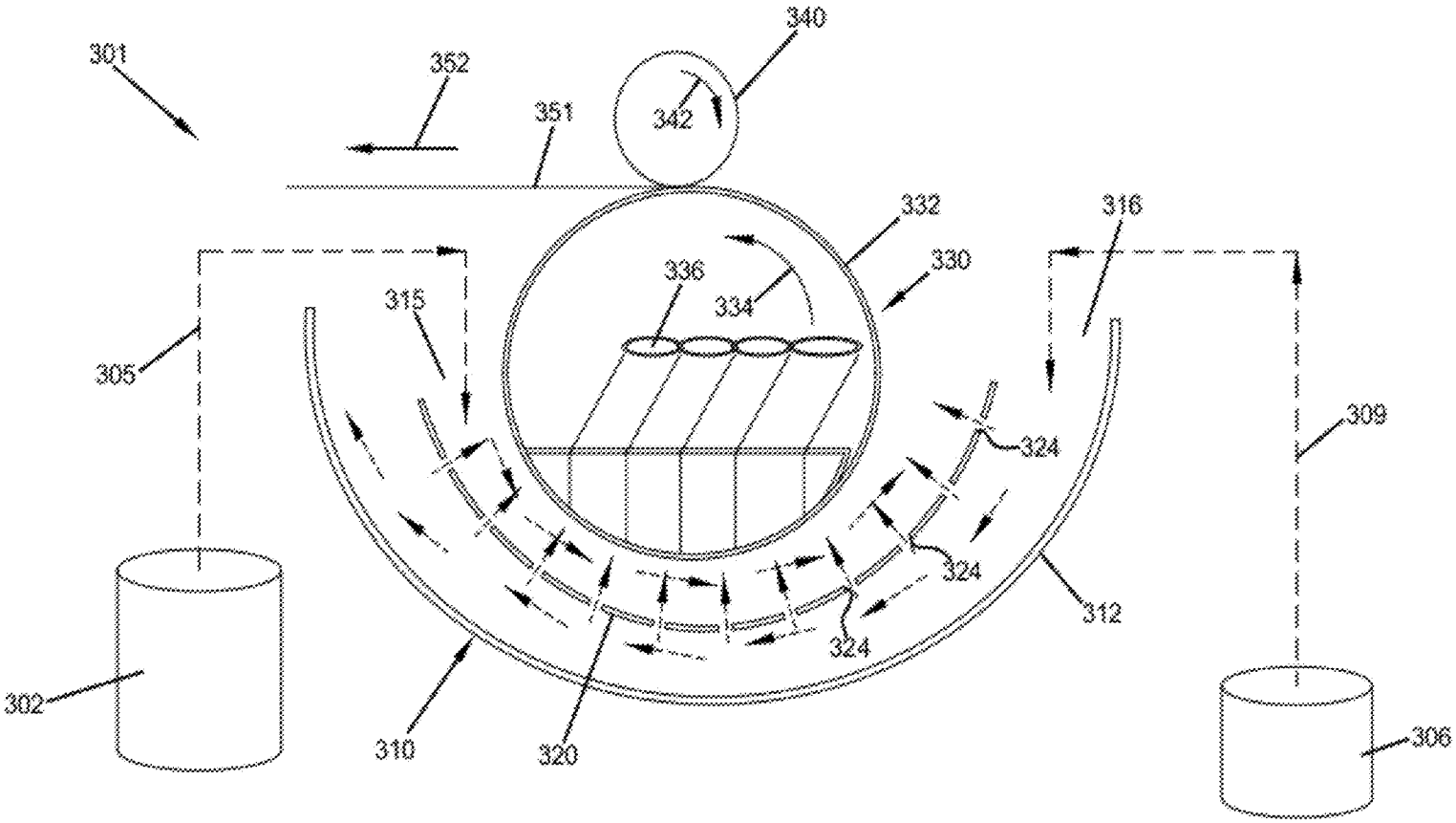

In FIG. 11, cylinder forming apparatus 301 includes a first source 302 of a first flow stream 305 and a second source 306 of a second flow stream 309. Flow stream 305 enters vat 310 at opening 315. Flow stream 309 enters vat 310 at opening 316. Disposed inside vat 310 is arcuate mixing partition 320 having openings 324, and cylinder 330. The first flow stream 305 enters vat 310 at first side 315 between the arcuate mixing partition 320 and cylinder 330. The second flow stream 309 enters vat 310 at second side 316 between vat wall 312 and arcuate mixing partition 320. It will be appreciated that the two flow streams flow in generally opposing directions through portions of the vat 310. The two flow streams 305, 309 become partially mixed as they flow through openings 324 of arcuate mixing partition 320. As the flow streams 305, 309 mix, cylinder 330 having perforate surface 332 drains liquid from the combined flow stream to form nonwoven web 351. As the nonwoven web 351 forms, it is peeled away from cylinder 330 by couch roll 340 and is urged in direction 352 by the action of cylinder 330 rotating in direction 334 against couch roll 340 rotating in direction 342. In some embodiments of FIG. 11, the cylinder 330 further includes optional suction apparatus 336 that is engaged to suction liquid through perforate surface 332. Use of suction apparatus 336 increases the achievable speed of web formation of apparatus 300. The suction level of suction apparatus 336 as well as the percent area of the cylinder encompassing suction apparatus 336 is variable and is selected by the designer or operator of the cylinder former.

FIGS. 12-15 depict cylinder forming apparatuses generally known as the "dry vat" type. Thus, direction of the flow streams applied to such cylinder formers are in a generally vertical disposition, and the forming area is generally restricted compared to the previously described vat type cylinder formers. Additionally, in some embodiments, dry vat type formers are pressure formers, that is, they employ pressure to the flow stream to urge the fiber carrying stream toward the cylinder. Thus, in some embodiments of FIGS. 12-15, the dry vat type configurations depicted further employ pressure similarly to pressure formers of conventional configuration.

Figure 12:
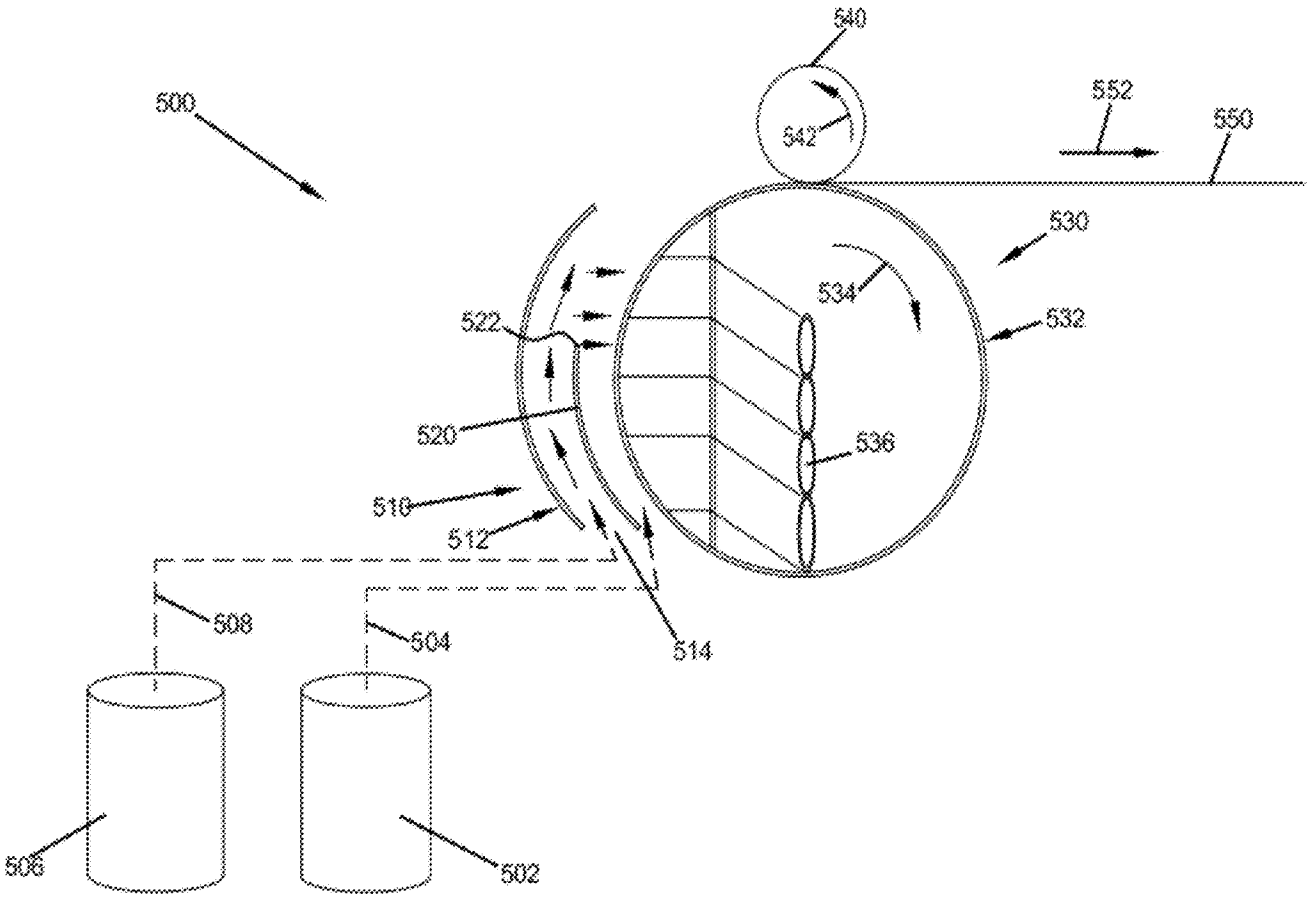

In FIG. 12, an apparatus 500 includes a first source 502 of a first flow stream 504 and a second source 506 of a second flow stream 508. The flow streams 504, 508 enter dry vat 510, defined by vat wall 512, at opening 514. Disposed inside dry vat 510 is arcuate mixing partition 520 having distal end 522, and cylinder 530. The first flow stream 504 enters dry vat 510 at first side 514 between arcuate mixing partition 520 and cylinder 530. The second flow stream 508 enters dry vat 510 at first side 514 between vat wall 512 and arcuate mixing partition 520. The two flow streams 504, 508 become partially mixed as they flow past the distal end 522 of arcuate mixing partition 520. As the flow streams 504, 508 mix, cylinder 530 having perforate surface 532 drains liquid from the combined flow stream to form nonwoven web 550. As the nonwoven web 550 forms, it is peeled away from cylinder 530 by couch roll 540 and is urged in direction 552 by the action of cylinder 530 rotating in direction 534 against couch roll 540 rotating in direction 542. In some embodiments of FIG. 12, the cylinder 530 further includes optional suction apparatus 536 that is engaged to suction liquid through perforate surface 532. Use of suction apparatus 536 increases the achievable speed of web formation of apparatus 500. The suction level of suction apparatus 536 as well as the percent area of the cylinder encompassing suction apparatus 536 is variable and is selected by the designer or operator of the cylinder former.

Figure 13:
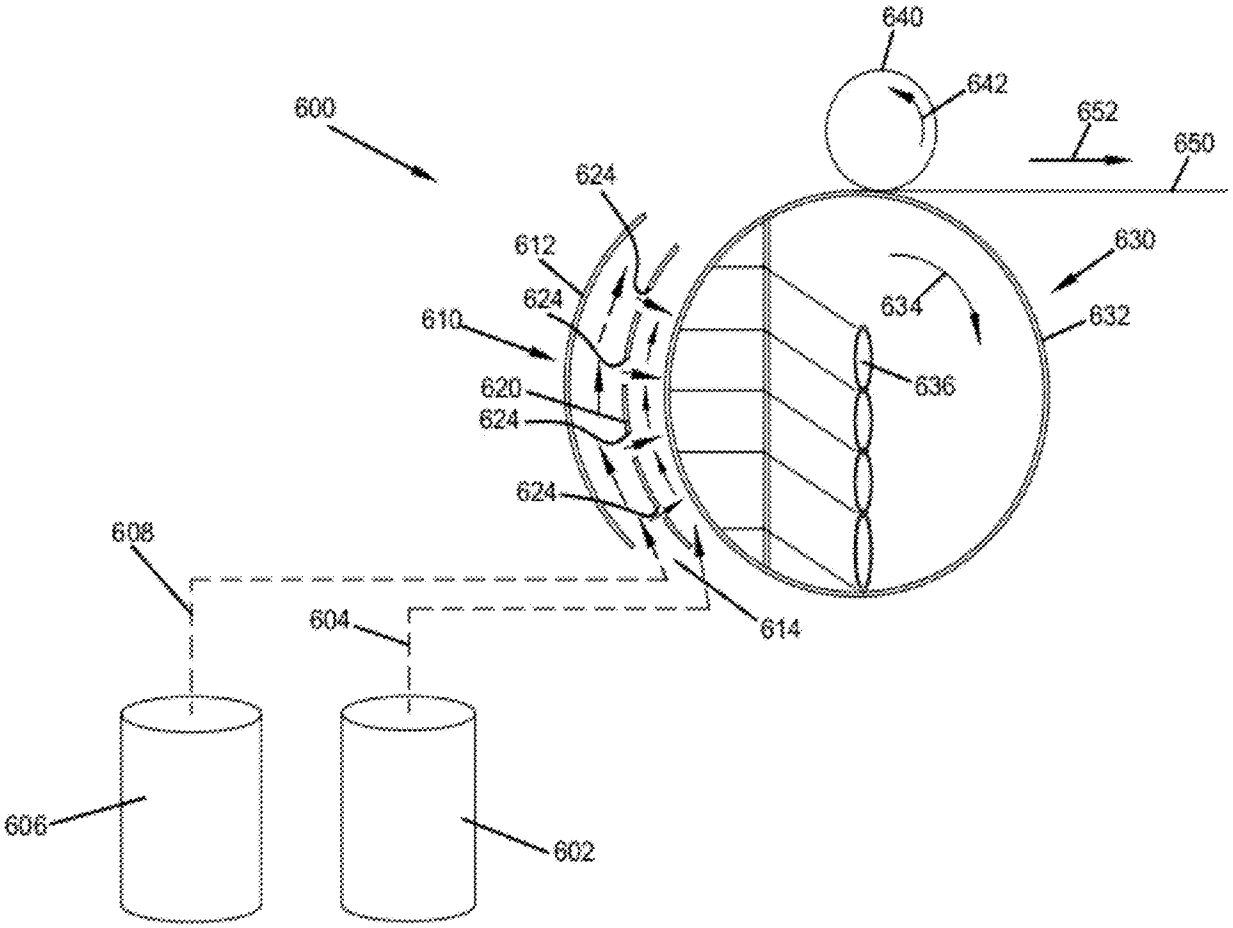

In FIG. 13, a cylinder forming apparatus 600 includes a first source 602 of a first flow stream 604 and a second source 606 of a second flow stream 608. The flow streams 604, 608 enter into dry vat 610, defined by vat wall 612, at opening 614. Disposed inside dry vat 610 is arcuate mixing partition 620 having openings 624, and cylinder 630. The first flow stream 604 enters dry vat 610 at first side 614 between arcuate mixing partition 620 and cylinder 630. The second flow stream 608 enters dry vat 610 at first side 614 between vat wall 612 and arcuate mixing partition 620. The two flow streams 604, 608 become partially mixed as they flow through openings 624 of arcuate mixing partition 620. As the flow streams 604, 608 mix, cylinder 630 having perforate surface 632 drains liquid from the combined flow stream to form nonwoven web 650. As the nonwoven web 650 forms, it is peeled away from cylinder 630 by couch roll 640 and is urged in direction 652 by the action of cylinder 630 rotating in direction 634 against couch roll 640 rotating in direction 642. In some embodiments of FIG. 13, the cylinder 630 further includes optional suction apparatus 636 that is engaged to suction liquid through perforate surface 632. Use of suction apparatus 636 increases the achievable speed of web formation of apparatus 600. The suction level of suction apparatus 636 as well as the percent area of the cylinder encompassing suction apparatus 636 is variable and is selected by the designer or operator of the cylinder former.

Figure 14:
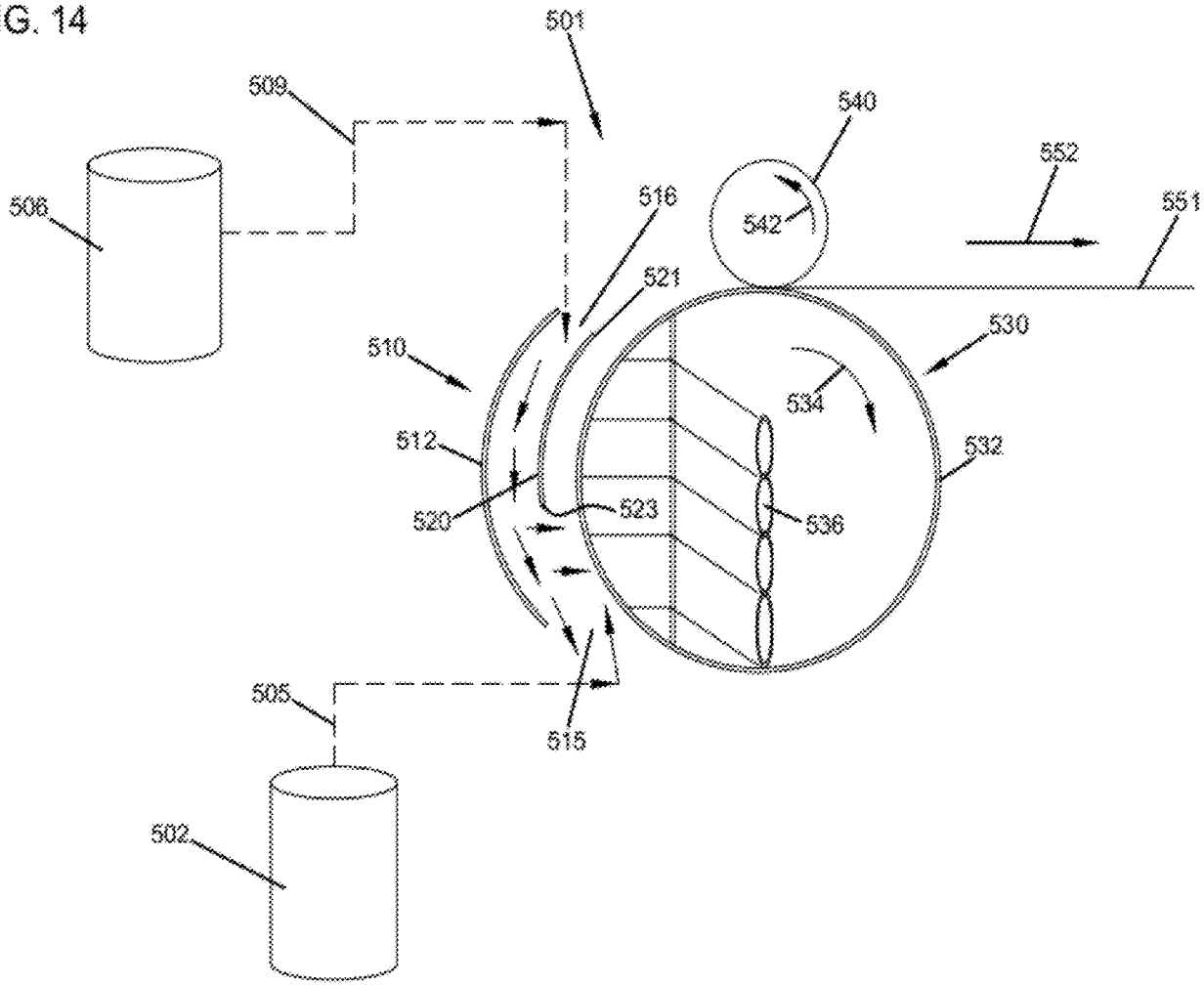

In FIG. 14, an apparatus 501 includes a first source 502 of a first flow stream 505 and a second source 506 of a second flow stream 509. Flow stream 505 enters dry vat 510 at opening 515. Flow stream 509 enters dry vat 510 at opening 516. Disposed inside dry vat 510 is arcuate mixing partition 520 having first end 521 and second end 523, and cylinder 530. The second flow stream 509 enters dry vat 510 at second end 516 between vat wall 512 and arcuate mixing partition 520. It will be appreciated that the two flow streams flow in generally opposing directions through portions of the dry vat 510. The two flow streams 505, 509 become partially mixed as they flow past the second end 523 of arcuate mixing partition 520. As the flow streams 505, 509 mix, cylinder 530 having perforate surface 532 drains liquid from the combined flow stream to form nonwoven web 551. As the nonwoven web 551 forms, it is peeled away from cylinder 530 by couch roll 540 and is urged in direction 552 by the action of cylinder 530 rotating in direction 534 against couch roll 540 rotating in direction 542. In some embodiments of FIG. 14, the cylinder 530 further includes optional suction apparatus 536 that is engaged to suction liquid through perforate surface 532. Use of suction apparatus 536 increases the achievable speed of web formation of apparatus 501. The suction level of suction apparatus 536 as well as the percent area of the cylinder encompassing suction apparatus 536 is variable and is selected by the designer or operator of the cylinder former.

Figure 15:
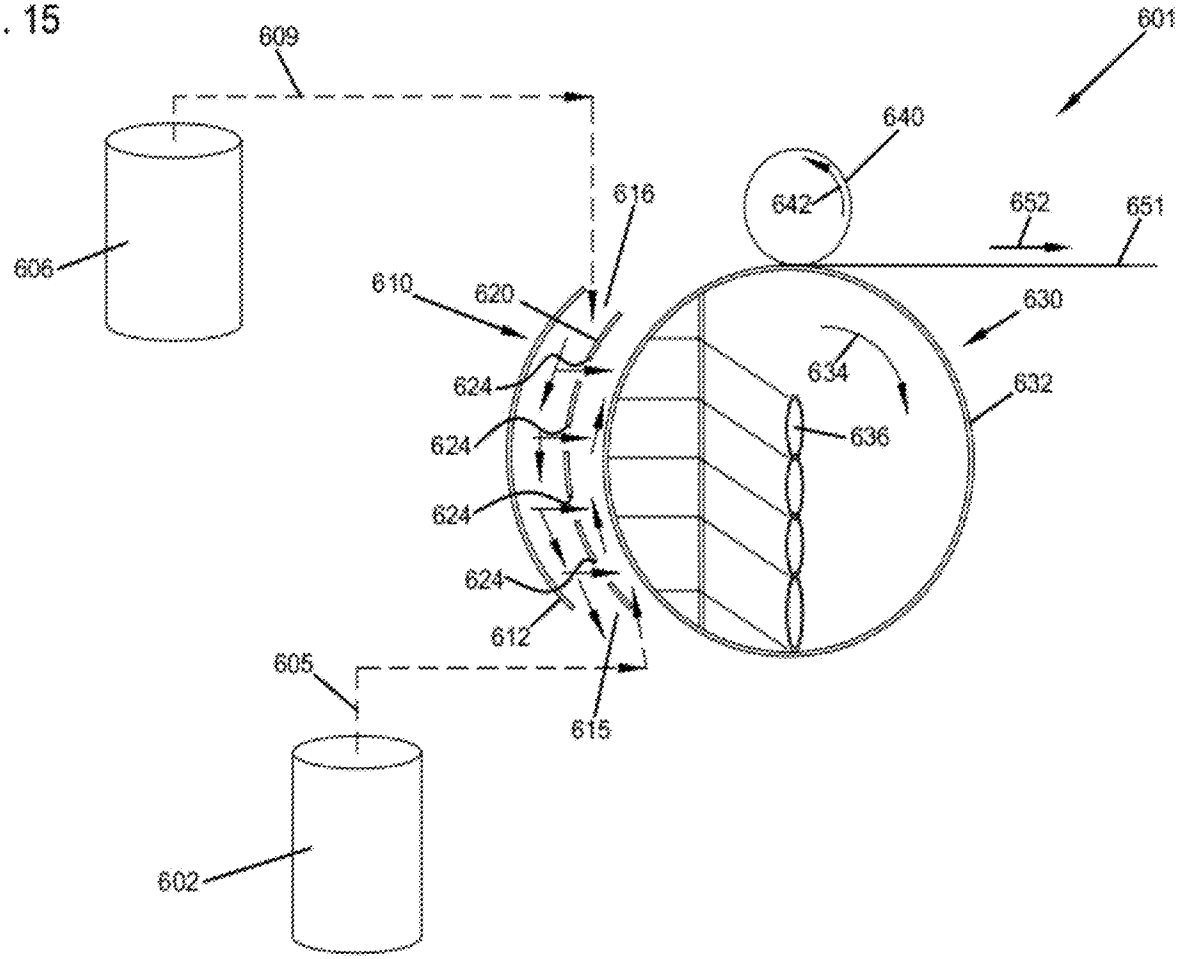

In FIG. 15, cylinder forming apparatus 601 includes a first source 602 of a first flow stream 605 and a second source 606 of a second flow stream 609. Flow stream 605 enters dry vat 610 at opening 615. Flow stream 609 enters dry vat 610 at opening 616. Disposed inside dry vat 610 is arcuate mixing partition 620 having openings 624, and cylinder 630. The first flow stream 605 enters dry vat 610 at first side 615 between the arcuate mixing partition 620 and cylinder 630. The second flow stream 609 enters dry vat 610 at second side 616 between vat wall 612 and arcuate mixing partition 620. It will be appreciated that the two flow streams flow in generally opposing directions through portions of the dry vat 610. The two flow streams 605, 609 become partially mixed as they flow through openings 624 of arcuate mixing partition 620. As the flow streams 605, 609 mix, cylinder 630 having perforate surface 632 drains liquid from the combined flow stream to form nonwoven web 651. As the nonwoven web 651 forms, it is peeled away from cylinder 630 by couch roll 640 and is urged in direction 652 by the action of cylinder 630 rotating in direction 634 against couch roll 640 rotating in direction 642. In some embodiments of FIG. 15, the cylinder 630 further includes optional suction apparatus 636 that is engaged to suction liquid through perforate surface 632. Use of suction apparatus 636 increases the achievable speed of web formation of apparatus 601. The suction level of suction apparatus 636 as well as the percent area of the cylinder encompassing suction apparatus 636 is variable and is selected by the designer or operator of the cylinder former.

In one embodiment, the fibrous media relates to a composite, non-woven, wet laid media having formability, stiffness, tensile strength, low compressibility, and mechanical stability for filtration properties; high particulate loading capability, low pressure drop during use and a pore size and efficiency suitable for use in filtering fluids, for example, gases, mists, or liquids. A filtration medium of one embodiment is wet laid and is made up of randomly oriented array of media fiber.

The fiber web that results from such a cylinder forming process using an arcuate mixing partition can have a region over which there is a gradient of a fiber characteristic and over which there is a change in the concentration of a certain fiber, but without having two or more discrete layers. This region can be the entire thickness or width of the medium or a portion of the medium thickness or width. The web can have a gradient region as described and a constant region having minimal change in fiber or filter characteristics. The fiber web can have the gradient without the flow disadvantages that are present in other structures that do have an interface between two or more discrete layers. In other structures that have two or more discrete layers that are joined together, an interface boundary is present, which may be a laminated layer, a laminating adhesive or a disrupting interface between any two or more layers. By using the gradient-forming arcuate mixing partition apparatus in a wet-laid cylinder forming process, it is possible to control web formation in the manufacture of wet laid media and avoid those types of discrete interfaces. The resulting media can be relatively thin while maintaining sufficient mechanical strength to be formed into pleats or other filtration structures.

3. Further Description of Methods and Apparatuses

A substantial advantage of the technology of the invention is to obtain an array of media with a range of useful properties using one or two fiber slurries and a single step process using modified versions of known cylinder forming apparatuses and processes.

In one embodiment, this invention utilizes a single pass cylinder forming process to generate a gradient within the dimensions of a fibrous web. By a single pass, it is meant that the mixing of slurries or flow streams and deposition of fibers occurs only once during a production run to produce a gradient media. No further processing is done to enhance the gradient. The single pass process using the arcuate mixing partition in conjunction with a cylinder forming apparatus provides a gradient media without a discernable or detectable interface within the media. The gradient within the media can be defined from top to bottom or across the thickness of the media. Alternatively or in addition, a gradient within the media can be defined across a crossweb dimension of the media.

In another embodiment, the arcuate mixing partition is included in a cylinder forming apparatus that includes a first source configured to dispense a first fluid flow stream including a fiber and a second source configured to dispense a second fluid flow stream. The arcuate mixing partition is situated downstream from the source of the first and second flow streams, is positioned between the first and second flow streams, and defines one or more openings in the arcuate mixing partition that permit fluid communication and mixing between the first and second flow streams. The apparatus also includes a cylinder downstream from the first and second source, situated proximal to the first flow stream and the fluid communication area of the first and second flow streams, and is designed to receive at least a combined flow stream and form a nonwoven web by collecting the combined flow stream.

The arcuate mixing partition openings can have any geometrical shape. Such geometrical opening shapes are described herein as if the arcuate mixing partition were in a flattened configuration. One example is a slotted arcuate mixing partition. In one embodiment, the arcuate mixing partition defines rectangular openings which are slots in the cross-web direction, that is, the rectangles will span all or a portion of the length of the cylinder in the cylinder forming apparatus. In some embodiments, the rectangular slots extend across the entire cross web. In another embodiment, the arcuate mixing partition defines slots in machine direction. The apertures or slots can be of variable width. For example, in some embodiments the slots increase in width in the down web direction or the slots may increase in width in the cross web direction. In some embodiments the slots are spaced variably in the down web direction. In other embodiments, the slots proceed in the cross web direction from one side of the web to the other. In other embodiments, the slots proceed over only part the web from one side to the other. In other embodiments, the slots proceed in the down web direction, from the proximal end of the arcuate mixing partition to the distal end. For example, the slots can be parallel to the path of flow taken by the flow streams as they leave the sources. Combinations of slot designs or arrangements may be used in the arcuate mixing partition.

In other embodiments, the arcuate mixing partition defines open areas that are not slots, e.g. the open areas do not progress in the cross web direction from one side to the other. In such embodiments, the open areas in the arcuate mixing partition are discrete holes or perforations. In other embodiments, the openings are large round holes in the arcuate mixing partition several inches in diameter. In embodiments, the holes are circular, oval, rectilinear, triangular, or of some other shape. In one particular embodiment, the openings are a plurality of discrete circular openings. In some embodiments, the openings are regularly spaced over the arcuate mixing partition. In other embodiments, the openings are spaced irregularly or randomly over the arcuate mixing partition.

A purpose of incorporating open areas in the mixing partition is, for example, to supply fibers from one flow stream and mix with fibers from a second flow stream in controlled proportions. The mixing proportions of the two flow streams is controlled by varying the magnitude and location of open areas along the curved length of the arcuate mixing partition. For example, larger open areas provide more mixing of the flow streams and vice versa. The position, size, and shape of these open areas determines depth of mixing of the furnish streams during formation of the gradient fibrous web.

There can be many modifications of this invention relative to the distribution, shape, and sizes of open areas, within the arcuate mixing partition. Some of these modifications are, for example, 1) rectangular slots with progressively increasing/decreasing areas, 2) rectangular slots with constant areas, 3) varying number of slots with varying shapes and positions, 4) porous arcuate mixing partition with slots confined to initial section of the mixing partition base only, 5) porous arcuate mixing partition with slots confined to a distal section only, 6) porous arcuate mixing partition with slots confined to a middle section only, or 7) any other combination of slots or open areas. The mixing partition can be of variable length and width.

In the case of an arcuate mixing partition having no openings on the partition itself, the partition defines either one or two open areas in the cylinder forming apparatus, depending on the particular shape of the partition itself. Examples of such configurations are generally shown in FIG. 2A-C; many more examples are easily envisioned by one of skill. If the arcuate mixing partition is not as wide as the cylinder's length when situated in the cylinder forming apparatus, then the arcuate mixing partition describes either one or two discrete openings on either side of the cylinder's length depending on where, relative to the cylinder's length, the arcuate mixing partition is placed. In such embodiments, the partition length may traverse the entire flow path of the two flow streams, or less than the entire flow path of the two flow streams. In embodiments where the arcuate mixing partition length traverses the entire flow path of the two flow streams, there are either one or two openings defined by the partition and the only mixing of flow streams occurs at one or both sides of the crossweb direction. In embodiments where the arcuate mixing partition length traverses less than the entire flow path of the two flow streams, mixing occurs both at the sides of the crossweb direction and at the distal end of the arcuate mixing partition.

Two important arcuate mixing partition variables are the magnitude of the open area within the mixing partition and the location of the open area. These variables control the deposition of the mixed flow streams producing the fibrous web. The amount of mixing is controlled by the open areas in the arcuate mixing partition relative to the dimensions of the arcuate mixing partition. The one or more regions where mixing of the different flow streams occurs is determined by the position of the arcuate mixing partition and positions of the one or more opening(s) or slot(s) in the arcuate mixing partition. The size of the one or more openings determines the amount of mixing within a receiving region. The location of the opening, i.e. towards the distal or proximal end of the arcuate mixing partition, determines the depth of mixing of the flow streams resulting in the gradient region within the fibrous web of the gradient media. The pattern of slots or openings may be formed in a single piece of material, such as metal or plastic, of the base of the arcuate mixing partition. Alternatively, the pattern of slots or openings may be formed by many pieces of material of different geometric shapes. These pieces may be fabricated from metal or plastic to form the base of the arcuate mixing partition. In general, the amount of open area within the arcuate mixing partition is directly proportional to the amount of mixing between the two flow streams.

One specific cylinder former that can be modified to include the arcuate mixing partition described herein is the ROTOFORMER™ machine (available from Glens Falls Interweb, Inc. of South Glens Falls, N.Y.), which is a cylinder forming machine designed to form very dilute fiber slurries into fibrous media. In some embodiments, the cylinder former includes a drainage valve or other opening designed to allow excess slurry to exit the vat. In some such embodiments, the drainage opening provides for a continuous flow of slurry through the vat. Nylon fibers, polyester fibers (such as Dacron®), regenerated cellulose (rayon) fibers, acrylic fibers (such as Orlon®), cotton fibers, polyolefin fibers (i.e. polypropylene, polyethylene, copolymers thereof, and the like), glass fibers, and abaca (Manila Hemp) fibers are examples of fibers that are advantageously formed into fibrous media using such a modified cylinder forming apparatus.

While the medium described herein can be made to have a gradient in property across a region, free of interface or adhesive line, the medium once fully made can be assembled with other conventional filter structures to make a filter composite layer or filter unit. In embodiments, the medium is assembled with a base layer such as a membrane, a cellulosic medium, a glass medium, a synthetic medium, a scrim or an expanded metal support. In embodiments, the medium having a gradient is used in conjunction with many other types of media, such as conventional media, to improve filter performance or lifetime.

In embodiments, a perforate structure is used to support the gradient media under the influence of fluid under pressure passing through the gradient media. In embodiments, the filter structure is combined with additional layers of a perforate structure, a scrim, such as a high-permeability, mechanically-stable scrim, and additional filtration layers such as a separate particle loading layer. In one embodiment, such a multi-region gradient media combination is housed in a filter cartridge commonly used in the filtration of non-aqueous liquids. In other embodiments, such a multi-region gradient media combination is housed in a filter cartridge commonly used in the filtration of aqueous liquids. In still other embodiments, such a multi-region gradient media combination is housed in a filter cartridge commonly used in the filtration of gases, for example crankcase gases or air.

In one method for evaluating the degree of gradient in a media produced by the methods described herein, the media is split into different sections, and the sections are compared using Scanning Electron Micrographs (SEMs). The basic concept is to take a single layer sheet that has a gradient structure, and to split its thickness into multiple sheets that will have dissimilar properties that reflect what the former gradient structure looked like. The resulting media can be examined for the presence or absence of an interface or boundary within the gradient media. Another feature to study is the degree of smoothness of changes in media characteristics, for example, coarse porosity to fine porosity. It is possible, though not required, to add colored trace fibers to one of the sources of furnish, and then the distribution of those colored fibers can be studied in the resulting media. For example, in embodiments, colored fibers are added to one of the two flow streams during the gradient media formation. After the gradient media has been produced, a sample is removed for sectioning. Cryo-microtome analysis can be used to analyze the structure of gradient media. A fill material such as ethylene glycol is used to saturate the media before it is frozen. Thin frozen sections are sliced from a fibrous mat and analyzed microscopically for gradient structure such as fiber size or porosity. An SEM is then taken of each section so that the properties of each section can be compared. SEM analysis reveals certain gradient characteristics, particularly where two fibers having different sizes (length, diameter, or both) are employed in the two flow streams. SEM also reveals gradients of particles within the fibrous web, when a first flow stream having a fiber is mixed in gradient fashion with a second flow stream having at least a particle visible by SEM.

If colored fibers are added to one flow stream, and the second flow stream contains a non-colored fiber, the level of gradation in the sheet is shown by the amount of colored fibers present in that section. The sections can be tested with a color meter to quantify the amount of mixing of the fibers. It is also possible to analyze the sections of media using an efficiency tester, such as a fractional efficiency tester.

Another technique that can be used to analyze a gradient in a medium is Fourier Infrared Fourier Transfer Infrared (FTIR) spectra analysis. For example, FTIR can be used to show that the media sample has a difference in the concentration of a particular fiber on its two sides. If two chemically different fibers are used in the two flow streams, the unique FTIR spectra of those fibers can be used to show that the media has a difference in either the composition on its opposite sides. Similarly, where a particle is provided in one flow stream and a fiber in the other, FTIR spectra can show a chemical difference between gradient areas where low concentrations vs. high concentrations of particles are located.

Yet another technique that can be used is Energy dispersive X-ray spectroscopy (EDS), which is an analytical technique used for the elemental analysis or chemical characterization of a sample. As a type of spectroscopy, it relies on the investigation of a sample through interactions between electromagnetic radiation and matter, analyzing x-rays emitted by the matter in response to being hit with charged particles. Its characterization capabilities are due in large part to the fundamental principle that each element has a unique atomic structure allowing x-rays that are characteristic of an element's atomic structure to be identified uniquely from each other. Trace elements are embedded in the fiber structures and can be quantified in EDS characterization. In this application a gradient in a medium can be shown where there is a difference in the composition of fibers across a region, and the different in composition is apparent using EDS.

We claim:

1. A cylinder forming apparatus for making a nonwoven web, the cylinder forming apparatus comprising:

a) a first source configured to dispense a first fluid flow stream, and a second source configured to dispense a second fluid flow stream, wherein at least the first fluid flow stream comprises a fiber;

b) an arcuate mixing partition having one or more open areas and having a distal end downstream from the one or more sources wherein the mixing partition comprises a partition wall at the distal end, the arcuate mixing partition positioned between the first and second flow streams, the arcuate mixing partition defining one or more openings that permit fluid communication between the two flow streams;

c) a cylindrical receiving region situated downstream from the sources and proximal to the first flow stream and designed to receive at least a combined flow stream and form a nonwoven web by collecting fiber from the combined flow stream.

2. The apparatus of claim 1 wherein the one or more open areas are rectangular slots.

3. The apparatus of claim 1 wherein the first source is configured to dispense the first flow stream in the same direction as the second flow stream.

4. The apparatus of claim 1 wherein the first source is configured to dispense the first flow stream in the opposite direction as the second flow stream.

5. The apparatus of claim 1 wherein the cylinder is configured to rotate in the same direction as the first flow path.

6. The apparatus of claim 1 wherein the cylinder is configured to rotate in the opposite direction from the first flow path.

7. The apparatus of claim 1 wherein the apparatus is a vat type cylinder forming apparatus.

8. The apparatus of claim 1 wherein the apparatus is a dry vat type cylinder forming apparatus.

9. The apparatus of claim 1 wherein the partition wall is configured and arranged to isolate the first flow stream from the second flow stream at the distal end of the arcuate mixing partition.

10. A method of making a nonwoven web, the method comprising:

a) providing a first flow stream mixture comprising a fiber and a second flow stream mixture to a cylinder forming apparatus, the cylinder forming apparatus comprising i) a first source configured to dispense said first fluid flow stream mixture into a first path, and a second source configured to dispense said second fluid flow stream mixture into a second path;

ii) an arcuate mixing partition having one or more open areas and having a distal end downstream from the one or more sources wherein the mixing partition comprises a partition wall at the distal end, the arcuate mixing partition positioned between the first and second flow stream paths, the arcuate mixing partition defining one or more openings that permit fluid communication between the two flow streams; and iii) a cylindrical receiving region situated downstream from the sources and proximal to the first flow stream path and designed to receive at least a combined flow stream and form a nonwoven web by collecting fiber from the combined flow stream;

b) concurrently dispensing the first flow stream mixture into the first flow stream path and the second flow stream mixture into the second flow stream path such that at least some mixing between the first and second flow stream mixtures forms a combined flow stream; and c) forming a nonwoven web by collecting fiber from at least the combined flow stream on the cylinder.

11. The method of claim 10 wherein both the first and second flow stream mixtures comprise a fiber.

12. The method of claim 10 wherein the forming comprises forming a gradient through at least a portion of the thickness of the nonwoven web.

13. The method of claim 10 wherein the forming comprises forming a gradient through at least a crossweb portion of the nonwoven web.

14. The method of claim 10 wherein the forming comprises forming a gradient concurrently through at least a portion of both the thickness and at least a crossweb portion of the nonwoven web.

15. The apparatus of claim 1 wherein the mixing partition in conjunction with the partition wall form a chamber within the apparatus.

* * * * *